US011590793B2

(12) United States Patent
Casey

(10) Patent No.: US 11,590,793 B2
(45) Date of Patent: Feb. 28, 2023

(54) PAINT CAN ACCESSORY

(71) Applicant: Adrien Casey, Hudson, NY (US)

(72) Inventor: Adrien Casey, Hudson, NY (US)

( * ) Notice: Subject to any disclaimer, the term of this patent is extended or adjusted under 35 U.S.C. 154(b) by 0 days.

(21) Appl. No.: 17/341,347

(22) Filed: Jun. 7, 2021

(65) Prior Publication Data

US 2022/0009278 A1 Jan. 13, 2022

Related U.S. Application Data

(63) Continuation-in-part of application No. 16/599,863, filed on Oct. 11, 2019, now Pat. No. 11,052,701.

(51) Int. Cl.
*B44D 3/12* (2006.01)
*B65D 25/48* (2006.01)

(52) U.S. Cl.
CPC ..... *B44D 3/127* (2013.01); *B44D 3/128* (2013.01); *B65D 25/48* (2013.01)

(58) Field of Classification Search
CPC ..... B44D 3/127; B44D 3/128; B65D 25/48
See application file for complete search history.

(56) References Cited

U.S. PATENT DOCUMENTS 2,923,446 A * 2/1960 Ankney ..... B65D 47/123 222/570
3,899,107 A * 8/1975 Gaal ..... B44D 3/123 222/570
3,913,785 A * 10/1975 Pattershall ..... B65D 21/0224 220/733
4,022,344 A * 5/1977 Roamer ..... B44D 3/128 220/4.03
4,730,753 A * 3/1988 Grime ..... B44D 3/127 222/481
6,705,480 B1 * 3/2004 Saddler ..... B44D 3/12 220/4.03

* cited by examiner

*Primary Examiner* — Donnell A Long
(74) *Attorney, Agent, or Firm* — Law Office of Matthew M. Yospin; Matthew M. Yospin

(57) ABSTRACT

Apparatus is provided for an accessory for a paint can. The apparatus comprises a roughly cylindrical frame disposed for being securely seated on a paint can, which may securely receive the original paint can lid or a replacement lid. The apparatus may further comprise a sealable spout; an air vent; a rod for wiping paint from a brush; concavities to allow the handle to be used; a splash guard; a collar for securing the apparatus to a paint can; and/or a lid. A user may use the apparatus to store paint, and paint using the paint in the can, or poured from the can, without paint being wasted and covering the can. Paint on the can, or air leaks, creates problems: the paint in the can dries, or the information on the outside of the can and/or can lid is obscured, which the present invention solves.

15 Claims, 17 Drawing Sheets

FIG. 14A
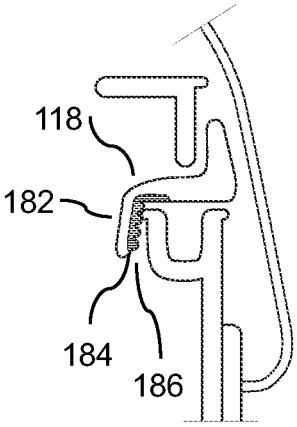
FIG. 14B
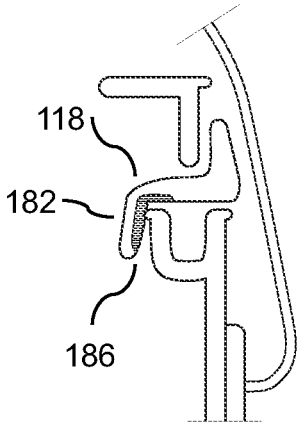
FIG. 14C
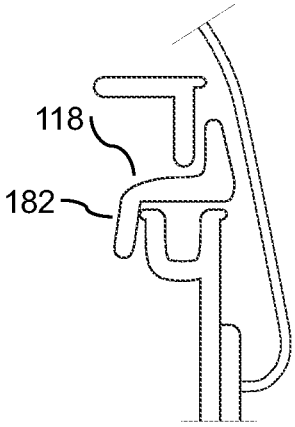
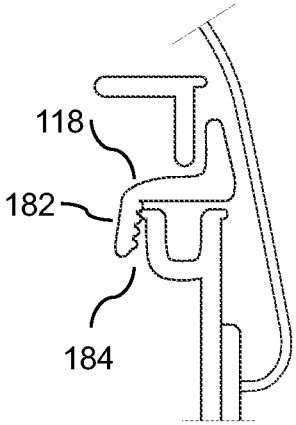
FIG. 14D
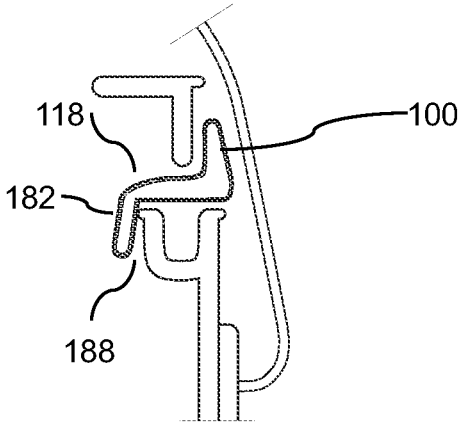
FIG. 14E FIG. 15A
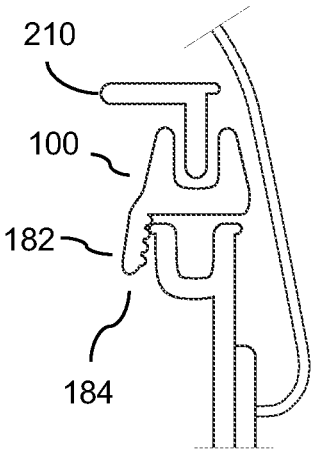
FIG. 15B
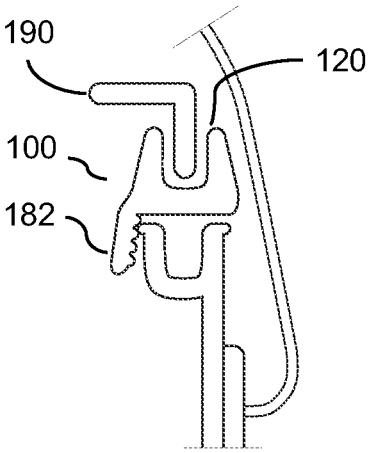
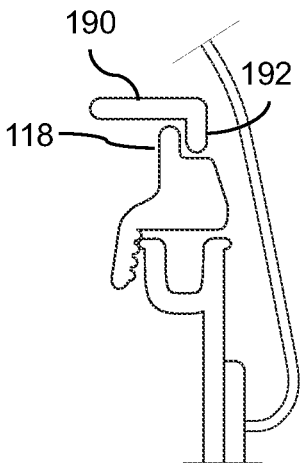
FIG. 15C
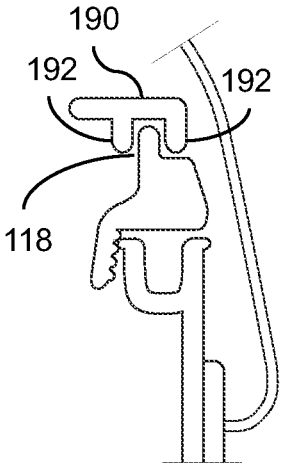
FIG. 15D
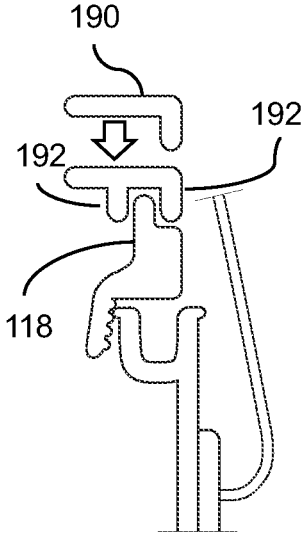
FIG. 15E

PAINT CAN ACCESSORY

CROSS-REFERENCE TO RELATED APPLICATIONS

This application claims the benefit of U.S. application Ser. No. 16/599,863, filed Oct. 11, 2019, which is incorporated by reference herein in its entirety.

FIELD OF THE INVENTION

The presently disclosed subject matter relates to providing apparatus for a paint can accessory, and more particularly, to an apparatus for a paint can accessory to allow improved pouring, storing, and painting using a paint can.

BACKGROUND OF THE INVENTION

People commonly buy paint in cans—typically, gallon, quart, pint, and 5.3-liter cans in the U.S.A., and other sizes may be used. When painting, a person typically uses paint from a can in one of two ways: by pouring paint from the can into a tray or other container for use with a roller or other device for applying paint, or by dipping a brush or other device for applying paint into the paint can. Problems exist with either method of accessing the paint. Pouring paint out of the paint can leads to paint in the paint-can-lid receiving indentation—the groove of the upper surface of the paint can, which groove is where the paint can lid, having a protrusion extending down from the underside of the lid, seals with the paint can. When paint gets in that paint-can-lid receiving indentation, it dries, and then the lid will be stuck in the dried paint, making the can difficult to open, and/or the dried paint prevents the lid from closing securely and sealing the can, so the entire can of paint dries out and cannot be used. Additionally, having wet paint in contact with that part of the can and the lid can lead to either the can or the lid rusting, and if either does, rust is likely to fall into the can of unused paint, which will taint the paint and make it unusable. Additionally, pouring paint tends to drip paint down the outside of the can as well.

When painting with a brush dipped directly into the paint in the paint can, the painter must usually remove excess paint from the brush, and/or distribute the paint more evenly through the material of the paintbrush than is possible just by dipping the brush. This is typically achieved by wiping the side of the brush against the inside of the upper surface of the paint can, which typically leads to paint being squeezed off of the brush and into the groove of the upper surface of the paint can, and sometimes down the outside of the can as well.

Additionally, the prior art requires a user to remove the lid and seal up the lid of a paint can repeatedly to pour paint, as it would be risky to leave a can open even when a user plans to pour it again soon: it might be knocked over, it might have things fall into the paint, and the paint in it might dry out. Opening a paint can, from a sealed condition, typically requires a user to use a tool, such as a screwdriver, to gain leverage to pry open the lid. This is a time-consuming process, and can be messy.

Also, paint is sometimes mixed as a custom color, and the information identifying the color of the paint is typically placed on the paint can lid (placing it on the side tends to obscure the information, as paint often drips down the outside of a can). Some paint can accessories replace the lid or obviate the need to keep the lid, but doing so means that you lose the information printed on the lid.

Paint cans are typically stacked for storage, and the lids have grooves set into them, which often match protrusions from the bottom of paint cans. When a replacement lid or other accessory is used with a paint can, it typically prevents anyone from securely stacking paint cans, which makes it harder to store cans of paint. Some paint can accessories block the rotation of the paint can handle from a lowered position, with the top of the handle touching the paint can's side, to a raised position, which makes it hard to carry and use a can of paint.

Prior art devices exist which attempt to solve some of the problems laid out above, which the present invention solves, but which don't provide solutions as effective as those disclosed herein, nor to as many of the problems set forth above which the present invention solves. Such devices, disclosed in the Information Disclosure Statement by Applicant filed with this application, attempt to solve, variously, the challenges of pouring paint from a paint can (the "Shur-Line 06100", the "Dynamic Enviro No Spill Paint Spout", the "Hyde 45970 5G Pouring Spout", and the "FoamPRO 135 Fits-All Large Bucket Pouring Spout") and the challenges of pouring paint from a can and providing a lid (the "SHUR-LINE Pour & Store Paint Can Lid", the "Allway Tools CPS 1 Gallon Deluxe Pouring Spout & Can Cover", the "Uni-Pro Pour And Store Paint Pot Lid", the "Replacement Metal 1-Gallon Paint Can Lid with Pour Spout", the "Plastic Lid for 1 Gal. Paint Can"), but such devices contain the shortcomings of not allowing the paint cans to be used with the original lids, and be easily and securely stacked, while providing a means to neatly pour paint, with easily replaced parts, and a brush wipe, and the ability to use the paint can's handle without obstruction.

SUMMARY OF THE INVENTION

The present invention meets all these needs, by disclosing apparatus for a paint can accessory to allow improved pouring, storing, and painting using a paint can. The present invention further addresses the problems of painting using the paint in a paint can without an accessory, or of other paint can accessories, in which paint gets into the paint-can-lid receiving indentation, which causes one or more of several problems: the paint in the paint-can-lid receiving indentation dries, making it difficult to get the paint-can lid to seal, or sticking the lid in place, making it difficult to re-open the paint can; or the paint causes the paint can and/or lid to rust, contaminating the remaining paint and making it worthless.

The present invention addresses the problems of the prior art, which do not present apparatus for pouring paint from a paint can without having paint pour down the outside of the paint can, which is wasteful, messy, and obscures the information on the outside of the paint can.

Further, the present invention introduces a product that allows a user to paint using the paint inside the paint can without dripping paint into the paint-can-lid receiving indentation or down the outside of the can, by providing, in one aspect of the present invention, a wiper rod which a user may use for wiping paint from a paint brush, which brush was dipped into the paint in the paint can, without wiping paint from the brush by wiping the brush against the top surface of the paint can, which leads to paint being squeezed from the brush into the paint-can-lid receiving indentation.

In one aspect of the present invention, apparatus is presented that allows the original lid of the paint can to be used with the apparatus to seal the paint can, and allow paint to be poured from the paint can using a spout without needing to open the lid. This saves time for the user, reduces the need to have a tool nearby to open the paint can lid, and reduces the mess and other problems (such as paint in the paint-can-lid receiving indentation) from pouring paint from the can directly. Using the original lid also allows the preservation of the original information that came with the paint can, as custom mixing of a color is typically printed or written on a sticker that is placed on the lid. Other apparatuses that seal a paint can obviate the original paint can lid, which means the original lid with the custom mixing information on the sticker is typically discarded.

In another aspect of the present invention, the apparatus, by allowing the original lid of the paint can—or any paint can lid of the same size—to be used on the apparatus to seal the paint can, also allows multiple paint cans to be stacked on top of each other. This is how paint cans, without accessories, are typically stored—but many prior-art paint can accessories replace the lid, rather than use the lid. By replacing the lid and not providing a ring at the top of the accessory that matches the bottom of a paint can, or by not having a flat surface on which a paint can may be stacked, prior-art accessories prevent cans from being stacked on top of cans using those prior-art accessories (unless the prior-art accessories are removed, which is not a practical solution for storage or use of the paint can and accessories). The present invention presents apparatuses that securely receive a paint can lid, and thus allow other paint cans to be stacked on a paint can without removing the accessory of the present invention.

In another aspect of the present invention, the lateral concavities allow the paint can handle to be raised and lowered without being hindered by the accessory, providing another improvement over the prior art paint can accessories.

In one aspect, the present invention comprises a paint can accessory apparatus to allow improved pouring, storing, and painting using a paint can, the apparatus comprising: a roughly cylindrical main body, which main body further comprises a body exterior, and a body interior, and a body lower surface further comprising a bottom base circular protrusion, and a proximal body upper surface, and a distal body upper surface; and a paint-can-lid receiving indentation, the surface of which is a paint-can-lid receiving indentation interior surface; and wherein the bottom base circular protrusion may be securely seated in a paint-can receiving indentation; and wherein a paint-can lid may be securely seated in the apparatus, with a paint-can-lid lower protrusion securely seated in the paint-can-lid receiving indentation; and a spout body, a spout closure, and a spout opening; and a wiper rod, a first wiper rod support, and a second wiper rod support, wherein the first wiper rod support is an open-jawed ring and the second wiper rod support is a circular ring; and a vent structure, disposed to be securely seated in a body-vent void, wherein the vent structure comprises a vent hole and a vent plug slot; and a plurality of lateral concavities.

In one aspect, the present invention comprises a paint can accessory apparatus to allow improved pouring, storing, and painting using a paint can, the apparatus comprising: a roughly cylindrical main body, which main body further comprises a body exterior, and a body interior, and a body lower surface further comprising a bottom base circular protrusion, and a proximal body upper surface, and a distal body upper surface; and a paint-can-lid receiving indentation, the surface of which is a paint-can-lid receiving indentation interior surface; and a spout body, a spout closure, and a spout opening.

In one aspect, the present invention comprises a paint can accessory apparatus in which the proximal body upper surface is covered with an upper surface proximal sealant which is affixed to some or all of the proximal body upper surface, and in which the distal body upper surface is covered with an upper surface distal sealant which is affixed to some or all of the distal body upper surface.

In one aspect, the present invention comprises a paint can accessory apparatus in which the upper surface proximal sealant and the upper surface distal sealant are not in contact with each other.

In one aspect, the present invention comprises a paint can accessory apparatus in which the upper surface proximal sealant and the upper surface distal sealant are in continuous contact with each other.

In one aspect, the present invention comprises a paint can accessory apparatus in which the body lower surface is covered with a lower surface proximal sealant on the proximal portion of the body lower surface, and on the upper inside portion of the bottom base circular protrusion; and in which the body lower surface is covered with a lower surface distal sealant on the distal portion of the body lower surface, and on the upper outside portion of the bottom base circular protrusion.

In one aspect, the present invention comprises a paint can accessory apparatus in which the lower surface proximal sealant and the lower surface distal sealant are not in contact with each other.

In one aspect, the present invention comprises a paint can accessory apparatus in which the lower surface proximal sealant and the lower surface distal sealant are in continuous contact with each other.

In one aspect, the present invention comprises a paint can accessory apparatus in which the apparatus further comprises a wiper rod, a first wiper rod support, and a second wiper rod support.

In one aspect, the present invention comprises a paint can accessory apparatus in which the apparatus further comprises a vent structure, disposed to be securely seated in a body-vent void; wherein the vent structure comprises a vent hole and a vent plug slot.

In one aspect, the present invention comprises a paint can accessory apparatus in which the vent hole is in an interior vent protrusion, which interior vent protrusion is disposed to be seated securely in a body-vent inner opening; and wherein an outer portion of the vent structure has a vent plug slot which is larger than the vent hole.

In one aspect, the present invention comprises a paint can accessory apparatus in which the main body comprises a relatively rigid material.

In one aspect, the present invention comprises a paint can accessory apparatus in which the vent structure comprises flexible or elastic material.

In one aspect, the present invention comprises a paint can accessory apparatus in which the apparatus further comprises a vent plug which is a cylinder approximately 18-20 mm in diameter and approximately 1-2 mm in height.

In one aspect, the present invention comprises a paint can accessory apparatus in which the apparatus further comprises a plurality of lateral concavities.

In one aspect, the present invention comprises a paint can accessory apparatus in which the plurality of lateral concavities are shaped to have a diameter of the apparatus be smaller towards the top of the apparatus.

In one aspect, the present invention comprises a paint can accessory apparatus in which the plurality of lateral concavities are shaped in the apparatus by having the cross-sectional shape of the apparatus be a triangle or approximately a rounded triangle.

In one aspect, the present invention comprises a paint can accessory apparatus in which the plurality of lateral concavities are arc-like or other shapes of material removed or not present above the lower part of the apparatus.

In one aspect, the present invention comprises a paint can accessory apparatus in which the spout body is formed as an extension of the main body, and wherein the spout body terminates in the spout opening.

In one aspect, the present invention comprises a paint can accessory apparatus to allow improved pouring, storing, and painting using a paint can, the apparatus comprising: a roughly cylindrical main body, which main body further comprises a body exterior, and a body interior, and a body lower surface further comprising a bottom base circular protrusion, and a proximal body upper surface, and a distal body upper surface; and a paint-can-lid receiving indentation, the surface of which is a paint-can-lid receiving indentation interior surface; and a spout body, a spout closure, and a spout opening; and a wiper rod, a first wiper rod support, and a second wiper rod support; and a vent structure, disposed to be securely seated in a body-vent void; and a plurality of lateral concavities.

In one aspect, the present invention comprises a paint can accessory apparatus to allow improved pouring, storing, and painting using a paint can, the apparatus comprising a main body, which main body further comprises a body exterior, a body interior, a body-vent void, and an inner collar; and a vent structure, disposed to be securely seated in the body-vent void, wherein the vent structure comprises a vent hole and a vent plug slot.

In one aspect, the present invention comprises a paint can accessory apparatus in which an inner collar further comprises a plurality of collar rings.

In one aspect, the present invention comprises a paint can accessory apparatus in which an inner collar further comprises a frictive region.

In one aspect, the present invention comprises a paint can accessory apparatus in which an inner collar further comprises a coating.

In one aspect, the present invention comprises a paint can accessory apparatus in which the apparatus further comprises a paint-can-lid receiving indentation, wherein a surface of the paint-can-lid receiving indentation is a paint-can-lid receiving indentation interior surface; and wherein a paint-can lid may be securely seated in the apparatus, with a paint-can-lid lower protrusion securely seated in the paint-can-lid receiving indentation.

In one aspect, the present invention comprises a paint can accessory apparatus in which the apparatus further comprises a paint-can-lid receiving indentation and an apparatus lid, and wherein the apparatus lid fits securely and reversibly into the paint-can-lid receiving indentation.

In one aspect, the present invention comprises a paint can accessory apparatus in which the apparatus further comprises a proximal body upper surface, and an apparatus lid which further comprises a plurality of apparatus-lid-prongs, and wherein the plurality of apparatus-lid-prongs are disposed to be securely seated distal to the proximal body upper surface.

In one aspect, the present invention comprises a paint can accessory apparatus in which the apparatus further comprises a spout body, a spout closure, and a spout opening.

In one aspect, the present invention comprises a paint can accessory apparatus in which the apparatus further comprises a pour guard.

In one aspect, the present invention comprises a paint can accessory apparatus in which the apparatus further comprises a wiper rod, a first wiper rod support, and a second wiper rod support.

In one aspect, the present invention comprises a paint can accessory apparatus in which a vent structure further comprises a distal wall configured to engage with the body-vent void.

In one aspect, the present invention comprises a paint can accessory apparatus in which a distal wall further comprises a wall-slot, and the main body further comprises a body-vent-coupler, and wherein the wall-slot is disposed in the distal wall to engage with the body-vent-coupler.

In one aspect, the present invention comprises a paint can accessory apparatus to allow improved pouring, storing, and painting using a paint can, the apparatus comprising a main body, which main body further comprises a body exterior, a body interior, a body-vent void, and a body lower surface further comprises a bottom base circular protrusion, and a proximal body upper surface, and a distal body upper surface; a spout body, a spout closure, and a spout opening; and a vent structure, disposed to be securely seated in the body-vent void; wherein the vent structure comprises a vent hole and a vent plug slot.

In one aspect, the present invention comprises a paint can accessory apparatus in which a vent structure further comprises a distal wall configured to engage with the body-vent void.

In one aspect, the present invention comprises a paint can accessory apparatus in which a distal wall further comprises a wall-slot, and the main body further comprises a body-vent-coupler, and wherein the wall-slot is disposed in the distal wall to engage with the body-vent-coupler.

In one aspect, the present invention comprises a paint can accessory apparatus in which the paint can accessory apparatus further comprises an inner collar, and wherein the inner collar comprises a plurality of collar rings.

In one aspect, the present invention comprises a paint can accessory apparatus in which the apparatus further comprises a paint-can-lid receiving indentation and an apparatus lid, and wherein the apparatus lid fits securely and reversibly into the paint-can-lid receiving indentation.

In one aspect, the present invention comprises a paint can accessory apparatus in which the apparatus further comprises an apparatus lid which further comprises a plurality of apparatus-lid-prongs, and wherein the plurality of apparatus-lid-prongs are disposed to be securely seated distal to the proximal body upper surface.

In one aspect, the present invention comprises a paint can accessory apparatus in which the apparatus further comprises a pour guard.

In one aspect, the present invention comprises a paint can accessory apparatus in which the apparatus further comprises a wiper rod, a first wiper rod support, and a second wiper rod support.

These aspects of the present invention, and others disclosed in the Detailed Description of the Drawings, represent improvements on the current art. This summary is provided to introduce a selection of concepts in a simplified form that are further described below in the Detailed Description of the Drawings. This Summary is not intended to identify key features or essential features of the claimed subject matter, nor is it intended to be used to limit the scope of the claimed subject matter.

BRIEF DESCRIPTION OF THE DRAWINGS

The foregoing summary, as well as the following detailed description of various aspects, is better understood when read in conjunction with the appended drawings. For the purposes of illustration, the drawings show exemplary aspects; but the presently disclosed subject matter is not limited to the specific methods and instrumentalities disclosed. In the drawings, like reference characters generally refer to the same components or steps of the device throughout the different figures. In the following detailed description, various aspects of the present invention are described with reference to the following drawings, in which:

FIG. 14A, FIG. 14B, FIG. 14C, FIG. 14D, and FIG. 14E each show a partial cross-section view, from the front, of an aspect of the apparatus of the present invention, in use on a paint can.

FIG. 15A, FIG. 15B, FIG. 15C, FIG. 15D, and FIG. 15E each show a partial cross-section view, from the front, of an aspect of the apparatus of the present invention, in use on a paint can.

DETAILED DESCRIPTION OF THE DRAWINGS

The presently disclosed invention is described with specificity to meet statutory requirements. But, the description itself is not intended to limit the scope of this patent. Rather, the claimed invention might also be configured in other ways, to include different steps or elements similar to the ones described in this document, in conjunction with other present or future technologies. Moreover, although the term "step" or similar terms may be used herein to connote different aspects of methods employed, the term should not be interpreted as implying any particular order among or between various steps herein disclosed unless and except when the order of individual steps is explicitly described. The word "approximately", as used herein, means 'within 10% of' as applied to numerical measures or measures of shape or curvature.

In the following description, numerous specific details are set forth to provide a thorough understanding of the invention. But, the present invention may be practiced without these specific details. Structures and techniques that would be known to one of ordinary skill in the art have not been shown in detail, in order not to obscure the invention. Referring to the figures, it is possible to see the various major elements constituting the apparatus and methods of use of the present invention.

The present invention comprises a paint can accessory apparatus: an apparatus 100 for a paint can 200 accessory apparatus to allow improved pouring, storing, and painting using a paint can 200.

Figure 8:
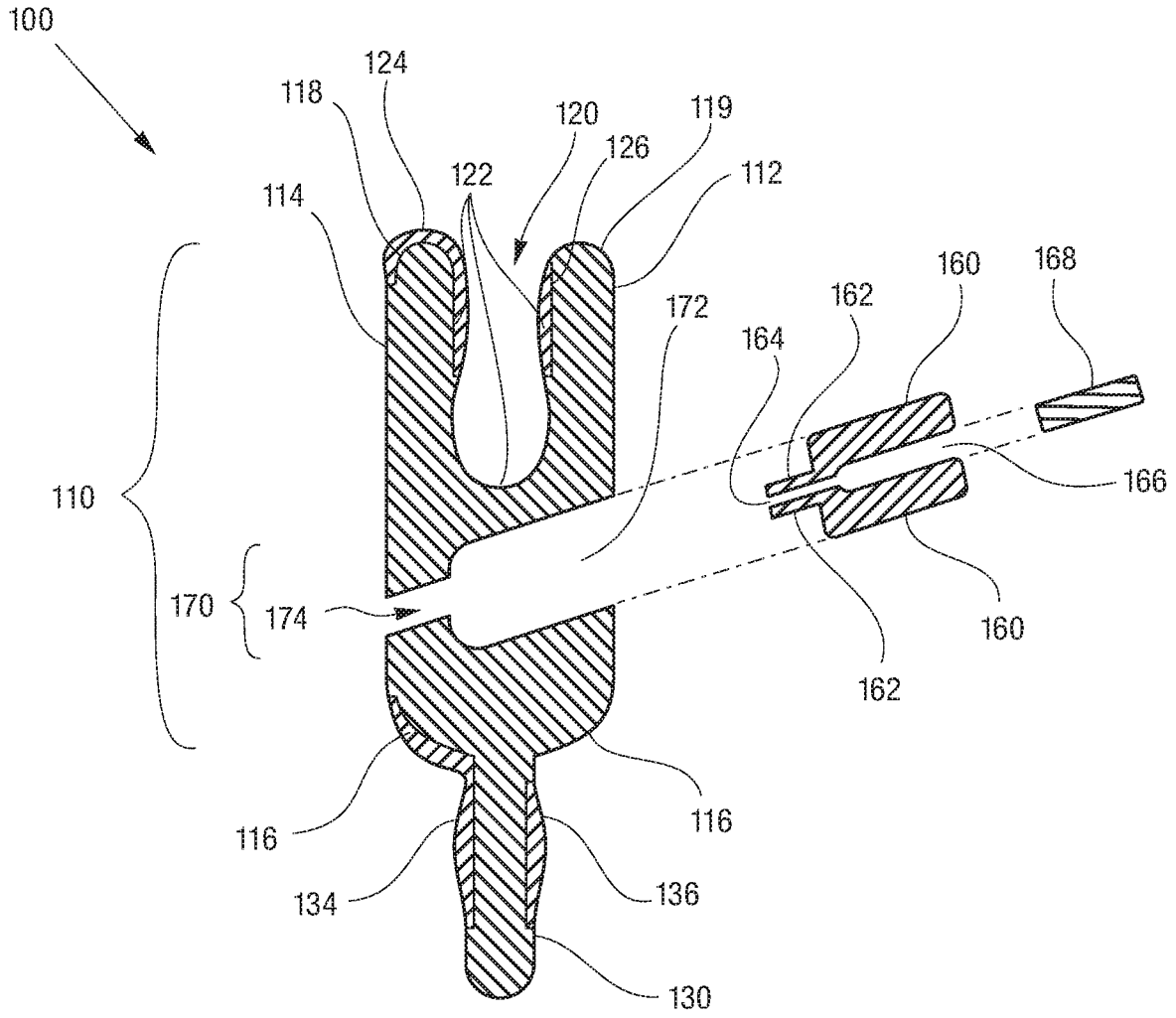
FIG. 8 shows an exploded cross-section view, from the side, of an aspect of the vent structure component and surfaces and sealants of the apparatus of the present invention.
Figure 9:
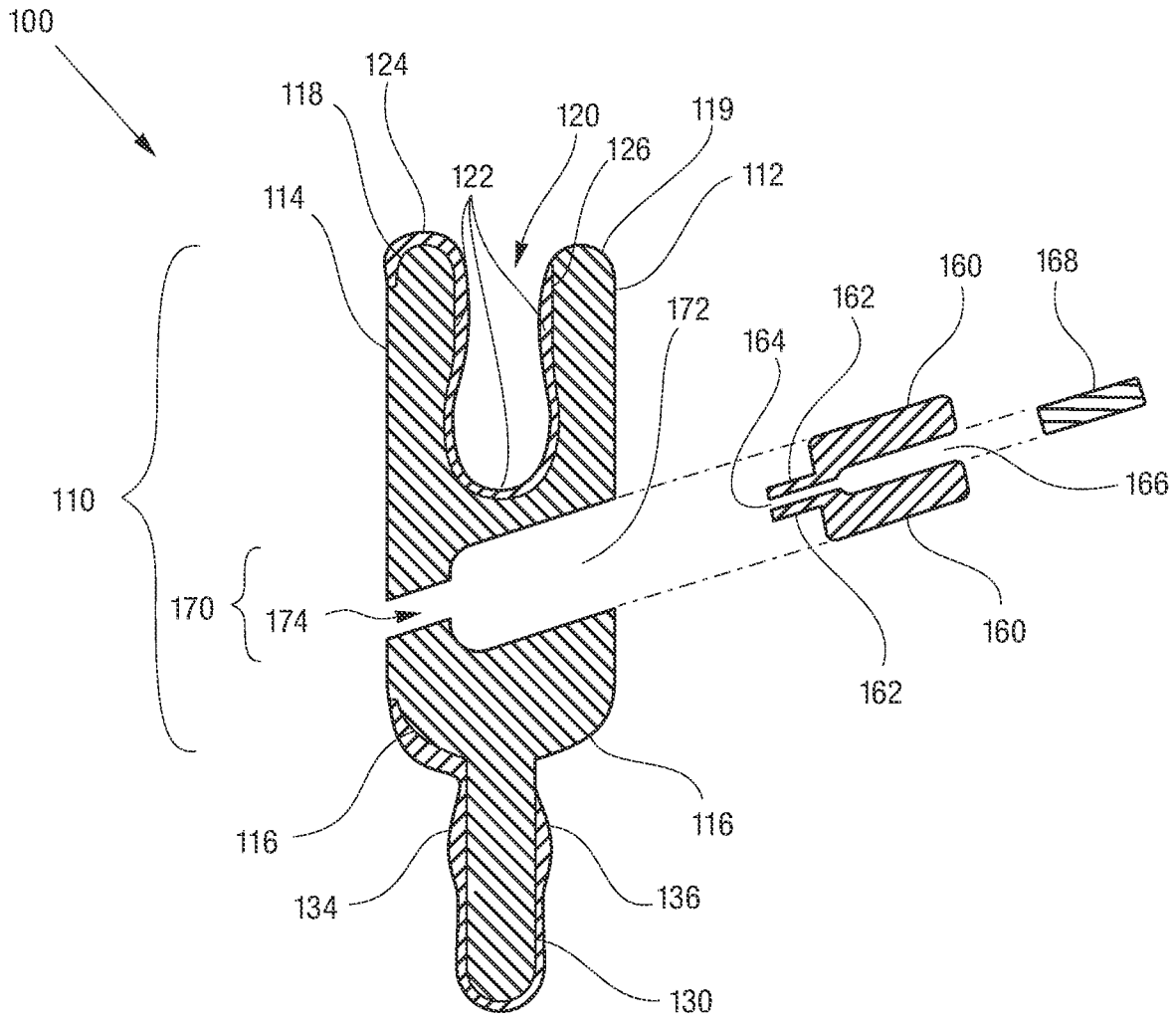
FIG. 9 shows a cross-section view, from the side, of an aspect of the vent structure component and surfaces and sealants of the apparatus of the present invention.
Figure 10:
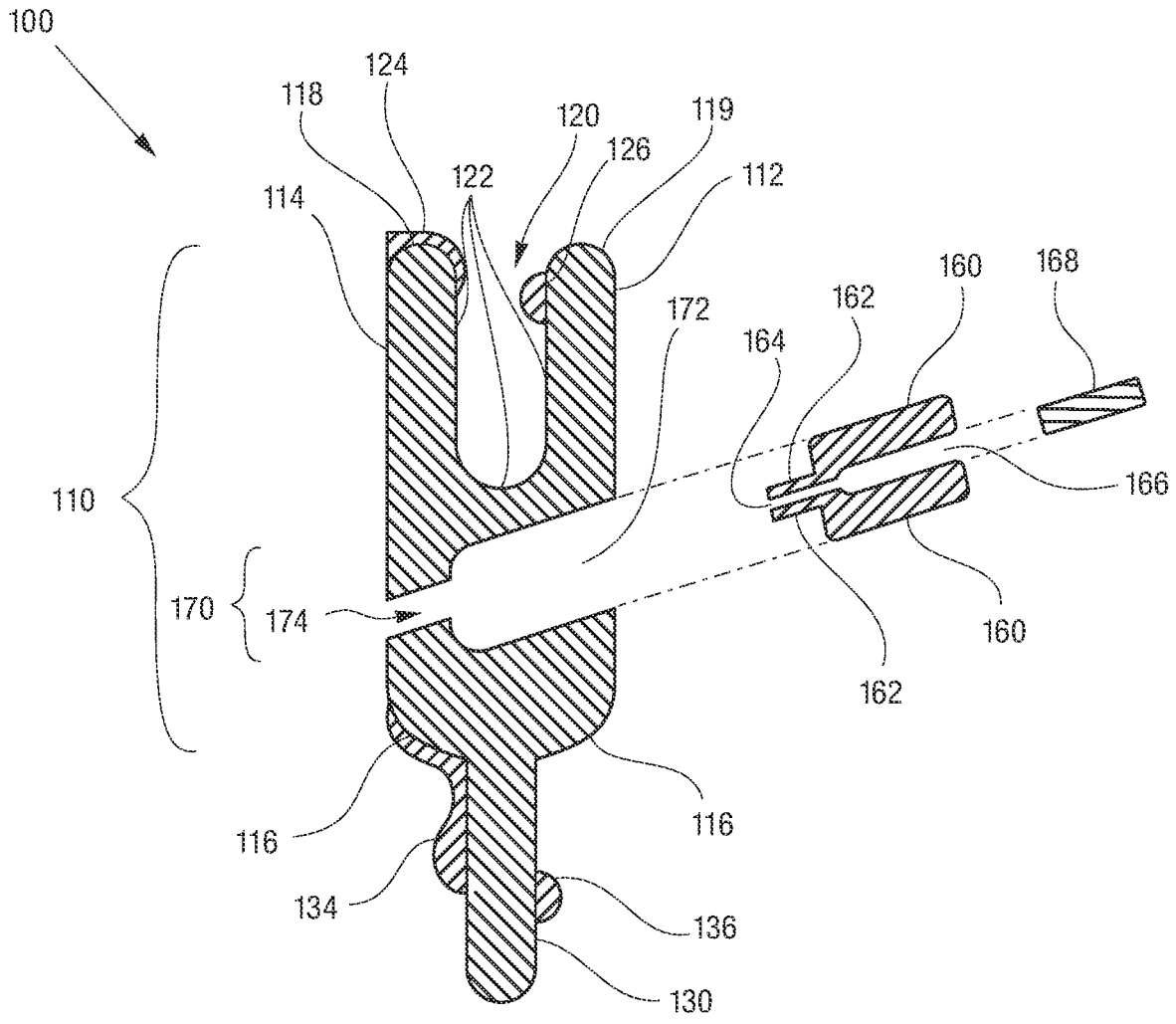
FIG. 10 shows a cross-section view, from the side, of an aspect of the vent structure component and surfaces and sealants of the apparatus of the present invention.

With reference to FIG. 1, FIG. 2, FIG. 3A, FIG. 3B, and FIG. 4, the apparatus 100 of the present invention comprises a roughly cylindrical main body 110, which main body 110 further comprises a body exterior 112 and a body interior 114 disposed respectively as the exterior and interior of the roughly cylindrical main body 110, and a body lower surface 116 disposed as the bottom of the roughly cylindrical main body 110, and a proximal body upper surface 118 (relatively closer to the center of the apparatus 100) and a distal body upper surface 119 (relatively farther from the center of the apparatus 100) disposed collectively as the top of the roughly cylindrical main body 110. With reference to FIG. 8, FIG. 9, and FIG. 10, the main body 110 further comprises, between the proximal body upper surface 118 and the distal body upper surface 119, a paint-can-lid receiving indentation 120, the surface of which is a paint-can-lid receiving indentation interior surface 122. The body lower surface 116 further comprises a bottom base circular protrusion 130.

With further reference to FIG. 2, FIG. 5, FIG. 8, FIG. 9, and FIG. 10, the apparatus 100 is disposed for securely seating on a paint can 200 and for securely receiving a paint-can lid 210 of the paint can 200. When a paint can 200 is used without the inventive apparatus 100, a paint-can-lid lower protrusion 212 of the paint-can lid 210 securely fits into a paint-can-receiving indentation 202 at the top of the paint can 200, with the paint-can-lid lower protrusion 212 securely seating into the paint-can-receiving indentation 202. When the apparatus 100 is used with a paint can 200, the bottom base circular protrusion 130 is securely seated in the paint-can-receiving indentation 202. The paint-can lid 210 may be securely seated in the apparatus 100, with the paint-can-lid lower protrusion 212 securely seated in the paint-can-lid receiving indentation 120, or the paint-can lid 210 may be left off of the apparatus 100 and thus not be sealing the paint can 200. It has been found advantageous to have the bottom base circular protrusion 130 sized and shaped to match the paint-can-lid lower protrusion 212, and to have the paint-can-lid receiving indentation 120 sized and shaped to match the paint-can-receiving indentation 202, so that the apparatus 100 can be securely seated on the paint can 200, and the paint-can lid 210 can be securely seated on the apparatus 100. As will be apparent to one of skill in the art, the apparatus 100 and the various components described herein which comprise the apparatus 100, may be sized and shaped to work with a plurality of sizes of paint cans, including but not limited to gallon paint cans, quart paint cans, pint paint cans, and 5.3-liter paint cans.

In some aspects of the present invention, with further reference to FIG. 8, FIG. 9, and FIG. 10, the proximal body upper surface 118 may be covered with an upper surface proximal sealant 124 which is affixed to some or all of the proximal body upper surface 118. In some aspects of the present invention, the distal body upper surface 119 may be covered with an upper surface distal sealant 126 which is affixed to some or all of the distal body upper surface 119. The upper surface proximal sealant 124 and the upper surface distal sealant 126 may, in some aspects of the present invention, not be in contact with each other, as shown in FIG. 8 and FIG. 10. In other aspects of the present invention, the upper surface proximal sealant 124 and the upper surface distal sealant 126 may be in continuous contact with each other, as shown in FIG. 9. In some aspects of the present invention, the body lower surface 116 may be covered with a lower surface proximal sealant 134 on the proximal or inner (to the center of the apparatus 100) portion of the body lower surface 116, and on the upper inside portion of the bottom base circular protrusion 130. In some aspects of the present invention, the body lower surface 116 may be covered with a lower surface distal sealant 136 on the distal or outer (from the center of the apparatus 100) portion of the body lower surface 116, and on the upper outside portion of the bottom base circular protrusion 130. The lower surface proximal sealant 134 and the lower surface distal sealant 136 may, in some aspects of the present invention, not be in contact with each other, as shown in FIG. 8 and FIG. 10. In other aspects of the present invention, the lower surface proximal sealant 134 and the lower surface distal sealant 136 may be in continuous contact with each other, as shown in FIG. 9. The object of the upper surface proximal sealant 124, upper surface distal sealant 126, lower surface proximal sealant 134, and/or lower surface distal sealant 136, in aspects of the present invention where any of the foregoing are present, is to provide an improved seal as to air and paint 230. As will be apparent to one of skill in the art, any of the upper surface proximal sealant 124, upper surface distal sealant 126, lower surface proximal sealant 134, and/or lower surface distal sealant 136 may be advantageously made of silicone or other material, now known or later invented, that provide a desired seal, and may be advantageously affixed in any manner now known or later invented. As will be apparent to one of skill in the art, each of the upper surface proximal sealant 124, upper surface distal sealant 126, lower surface proximal sealant 134, and lower surface distal sealant 136 advantageously will each extend as a ring of material around the apparatus 100 on the portions of the apparatus 100 to which such sealant elements are attached, as indicated in the cross-sections shown in FIG. 5, FIG. 8, FIG. 9, and FIG. 10, in order to achieve the goal of providing an improved seal as to air and paint 230.

In some aspects of the present invention, with further reference to FIG. 13 and FIG. 14A, FIG. 14B, FIG. 14C, FIG. 14D, and FIG. 14E, the apparatus 100 may further comprise an inner collar 182. The inner collar 182 extends down from the main body 110 to be fitted inside of the paint can 200, advantageously with the inner collar 182 snugly fitting on a proximal surface of the paint-can-receiving indentation 202, said proximal surface being the surface that is most in and most facing the interior of the paint can 200. The distal surface of the inner collar 182 may comprise a plurality of collar rings 184 disposed to provide a secure grip and easily reversible grip between the inner collar 182 and thus the apparatus 100, and the paint can 200. The proximal body upper surface 118 may tilt or slope downwards, from its distal extent to its proximal extent, to facilitate drainage of paint back into the paint can 200. With particular reference to FIG. 14A, FIG. 14B, FIG. 14C, FIG. 14D, and FIG. 14E, the inner collar 182 may comprise the plurality of collar rings 184, or a frictive region 186 which is less than the entirety of the inner collar 182, and is made frictive so that the inner collar 182 grips securely with the paint-can-receiving indentation 202. The inner collar 182 may comprise both the plurality of collar rings 184 and the frictive region 186, or neither of the plurality of collar rings 184 and the frictive region 186. In some aspects of the present invention, much or all of the apparatus 100 may be coated with a coating 188, the coating 188 comprising a substance to provide slip resistance or for easy cleanup, such substances may include but are not limited to silicone or rubber.

In some aspects of the present invention, with further reference to FIG. 15A, FIG. 15B, FIG. 15C, FIG. 15D, and FIG. 15E, the apparatus 100 may be configured to securely and reversibly fit the paint-can lid 210, as disclosed herein, and as shown in FIG. 15A. In other aspects, the apparatus 100 may further comprise an apparatus lid 190. The apparatus lid 190 may comprise similar features and dimensions to those of the paint-can lid 210, as shown in FIG. 15B, wherein the apparatus 100 comprises the paint-can-lid receiving indentation 120, and the apparatus lid 190 fits securely and reversibly into the paint-can-lid receiving indentation 120. In other aspects of the present disclosure, with reference to FIG. 15C and FIG. 15D, the apparatus lid 190 may comprise a plurality of apparatus-lid-prongs 192. The plurality of apparatus-lid-prongs 192 may advantageously be disposed to be securely seated distal to the proximal body upper surface 118, as in FIG. 15C. The plurality of apparatus-lid-prongs 192 may advantageously be disposed to be securely seated distal to and proximal to the proximal body upper surface 118, as in FIG. 15D. In other aspects of the present disclosure, with reference to FIG. 15E, the apparatus lid 190 may be screwed on to the main body 110. In these foregoing aspects of the present disclosure, the overall diameter of the main body 110 may be reduced, to be smaller than the diameter of the paint can 200, and in such aspects of the present disclosure, the lateral concavities 180 may not be needed, as the paint-can-handle 220 may be freely operable without the need for the lateral concavities 180 to allow the paint-can-handle 220 to pivot without obstruction by the main body 110.

With further reference to FIG. 1, FIG. 2, FIG. 3A, FIG. 3B, FIG. 4, and FIG. 7, the apparatus 100 further comprises a spout body 140, a spout cap 142, a spout closure 144, and a spout opening 146. The spout body 140 is at the front of the apparatus 100, and extends both out away from the roughly cylindrical main body 110, and up from the roughly cylindrical main body 110. The spout body 140 may connect to the roughly cylindrical main body 110 at an opening in the main body 110, or may be formed as an extension of the main body 110, or may be formed as a separate object from the main body 110 and be joined or affixed to the main body 110, so that paint 230 in the paint can 200 can be poured from the paint can 200 through the spout body 140. The spout body 140 terminates, at the distal end (away from the main body 110) of the spout body 140, in the spout opening 146, through which paint 230 may be poured. The spout opening 146 may be sealed with the spout cap 142, which spout cap 142 may be secured to the spout body 140 with the spout closure 144, and may be removed from the spout body 140. As will be understood by one of skill in the art, the spout closure 144 may secure the spout cap 142 with a threaded connection, such that the spout cap 142 is screwed onto the spout body 140 using the spout closure 144, and removed from it, both such removal and securing being possible many times. Other arrangements of spout closure 144 are possible, including but not limited to latches, pressure fittings, plugs, hinged closures with dispensing closures, snap-on closures, friction fittings, and others. Not all closures are suitable, for instance, single-use snap-on closures that could not be used to re-seal the spout body 140 would not be suitable for use as the spout closure 144.

With reference to FIG. 1, FIG. 2, FIG. 3A, and FIG. 3B, the apparatus 100 may further comprise a wiper rod 150, a first wiper rod support 152, and a second wiper rod support 154. The wiper rod 150 may be used to wipe or squeeze excess paint from a brush 250 that a user 240 is using to dip into the paint 230 in the paint can 200, so as to control the amount of paint 230 on the brush 250. The first wiper rod support 152 and the second wiper rod support 154 may be affixed to the body interior 114 of the apparatus 100, or the first wiper rod support 152 and the second wiper rod support 154 may be formed as part of the body interior 114. The first wiper rod support 152 and the second wiper rod support 154 are disposed on the body interior 114 far enough apart from each other that the length of the wiper rod 150 required to span them, as a straight or approximately straight object, is long enough to accommodate many sizes of brush 250. It has been found advantageous to have the first wiper rod support 152 be a circular ring raised from the surface of the body interior 114 (that is, towards the center of the apparatus 100), and to have the second wiper rod support 154 be an open-jawed ring (that is, shaped approximately like the letter "C", comprising most but not all of a circular or approximately circular ring) raised from the surface of the body interior 114 (that is, towards the center of the apparatus 100). It will be understood by one of skill in the art that the second wiper rod support 154 could be a circular ring and the first wiper rod support 152 could be an open-jawed ring, or they both could be circular rings or both open-jawed rings. By making at least one of the first wiper rod support 152 and the second wiper rod support 154 open-jawed rings, a user 240 may easily replace the wiper rod 150 if the wiper rod 150 becomes lost, damaged, rusty, paint-encrusted, or if the user 240 desires to replace the wiper rod 150 for any reason. The wiper rod 150 may be made from and/or replaced with a plastic or metal rod of suitable diameter to be secured to the body interior 114 of the apparatus 100 by the first wiper rod support 152 and the second wiper rod support 154.

Figure 11A:
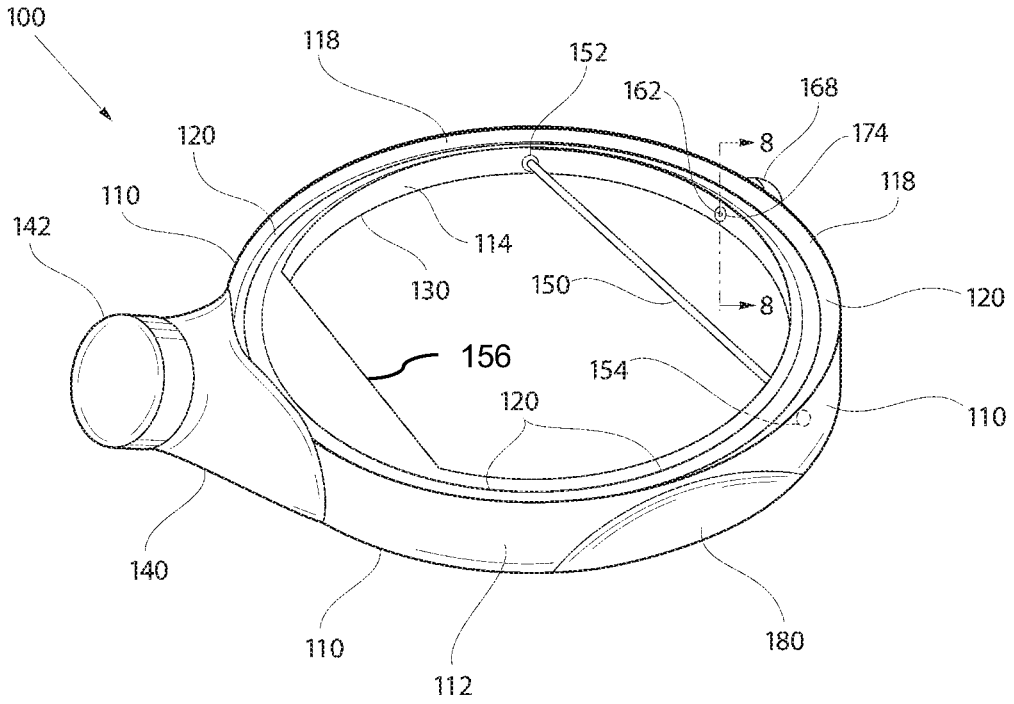
FIG. 11A shows a front and top perspective view of an aspect of the apparatus of the present invention.
Figure 11B:
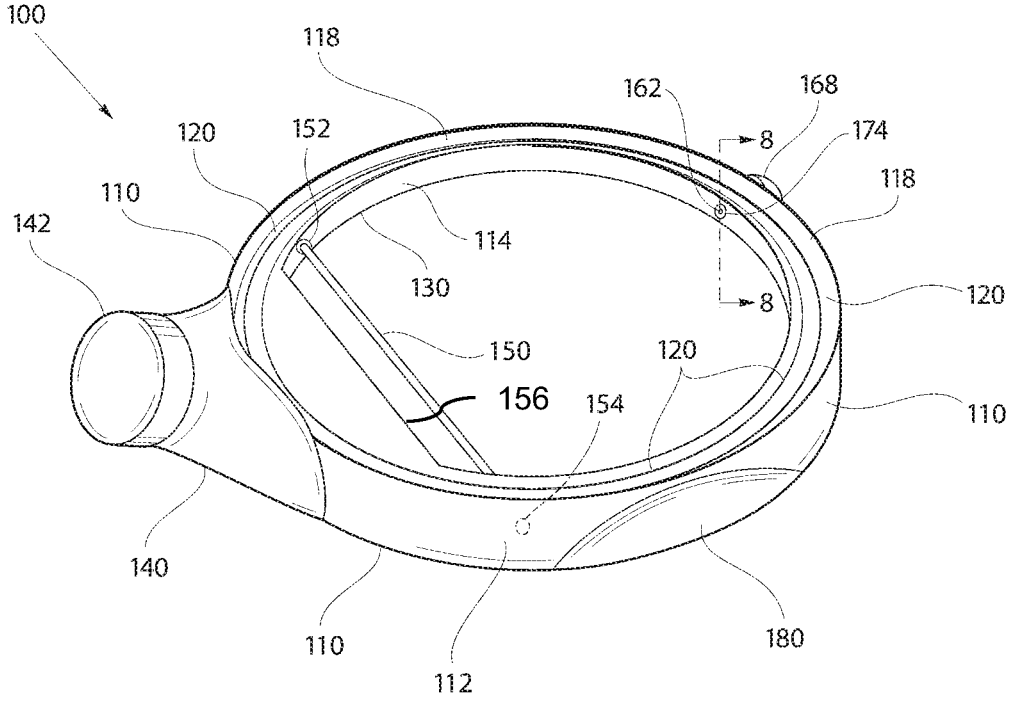
FIG. 11B shows a front and top perspective view of an aspect of the apparatus of the present invention.
Figure 12:
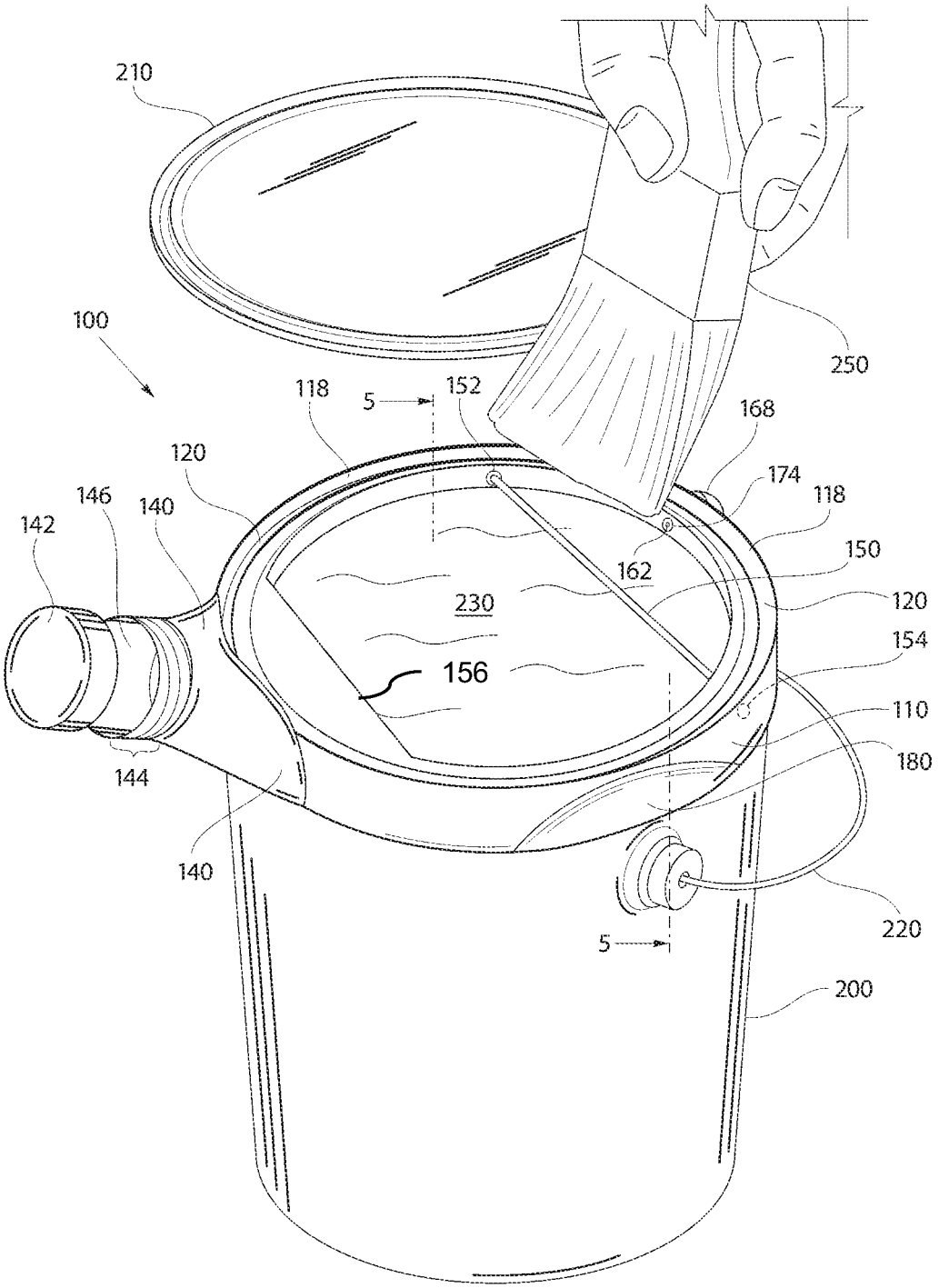
FIG. 12 shows a top and side perspective view of an aspect of the apparatus of the present invention, in use on a paint can.
Figure 13:
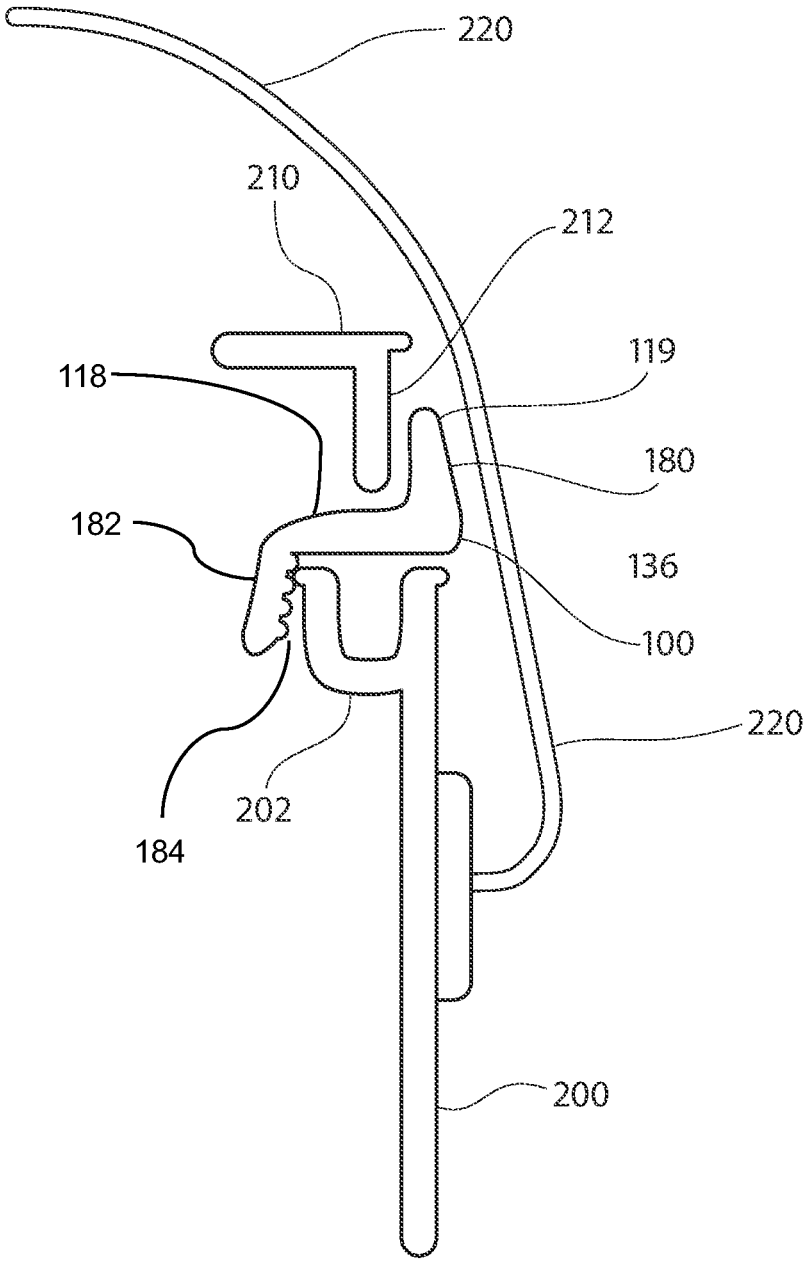
FIG. 13 shows a partial cross-section view, from the front, of an aspect of the apparatus of the present invention, in use on a paint can.

With reference to FIG. 11A, FIG. 11B, and FIG. 12, the apparatus 100 may further comprise a pour guard 156, which may be flat (co-planar with the plane of the apparatus 100 and the top of the paint can 200) or angled down slightly as the pour guard 156 extends from the front of the apparatus 100, nearer to the spout body 140, to the middle of the apparatus 100, such that paint 230 will drain off of the pour guard 156 and back into the paint can 200. The pour guard 156 serves to prevent or reduce the incidence of paint 230 spilling out of the paint can 200 when the paint 230 is being poured from the spout body 140. The pour guard 156 also serves to prevent paint 230 spilling or collecting between the apparatus 100 and the paint-can lid 210 or the apparatus lid 190, which would cause either lid (the paint-can lid 210 or the apparatus lid 190) to stick to the apparatus 100. The wiper rod 150 can be in multiple configurations within the apparatus 100, as is shown in FIG. 1, FIG. 2, FIG. 3A, FIG. 3B, FIG. 11A, FIG. 11B, and FIG. 12. The first wiper rod support 152 and the second wiper rod support 154 will, where used in such aspects of the present disclosure, be situated to position the wiper rod 150 in a desired location in the apparatus 100, including but not limited to towards the back of the apparatus 100, towards the front of the apparatus 100, or in the middle of the apparatus 100. The first wiper rod support 152 and the second wiper rod support 154 may comprise indentations in the main body 110, as they need not be raised from the proximal surface of the main body 110.

The wiper rod 150 may be replaceable as described above, or could be made integrated into the apparatus 100 in such a way that the wiper rod 150 cannot be replaced easily or at all. It has been found advantageous to have the wiper rod 150 be sized to be replaceable with common household items, including but not limited to wire of a gauge commonly found in clothes hangers, providing an advantage over prior art in that the components of the apparatus 100 are user-replaceable, rather than needing to discard an entire apparatus or purchase specialized replacement parts, which provides a further advantage of the present invention, in that it prevents excess cost and excess waste relative to the prior art.

With reference to FIG. 1, FIG. 2, FIG. 6, FIG. 7, FIG. 8, FIG. 9, and FIG. 10, the apparatus 100 may further comprise a vent structure 160. The vent structure 160 is disposed to be securely seated in a body-vent void 170 of the apparatus, the body-vent void 170 being a cavity or opening in the main body 110. The vent structure 160 functions to allow air to flow into the paint can 200 to equalize the air pressure inside and outside the paint can 200, when the paint can 200 is sealed with the apparatus 100 and paint-can lid 210 on top of the apparatus 100, and the spout cap 142 is removed to allow paint 230 to be poured from the paint can 200 through the spout opening 146 of the spout body 140. By allowing air to flow into the paint can 200 through the vent structure 160, the paint 230 can be poured smoothly out of the paint can 200 without air rushing in through the spout opening 146 to equalize the air pressure inside the paint can 200, which would interrupt the flow of paint 230 out of the paint can 200, and increase the likelihood of paint 230 sloshing and spilling as the user 240 attempts to pour the paint 230.

The vent structure 160 comprises a solid structure, which may be advantageously made of a flexible or elastic material, including but not limited to silicone, with an opening through the vent structure 160 to allow air to pass or flow to equalize air pressure, which opening comprises at least two parts: a vent hole 164 and a vent plug slot 166. The vent hole 164 is at the inner surface (closer to the body interior 114) of the vent structure 160, and the vent plug slot 166 comprises the majority of the opening in the vent structure 160, and traverses the majority of the vent structure 160, as can be seen in cross-section in FIG. 6, FIG. 7, and FIG. 8. The vent hole 164 may be in an interior vent protrusion 162 which protrudes from the vent structure 160 towards the body interior 114 of the apparatus 100. The interior vent protrusion 162 of the vent structure 160 is disposed to be seated securely in a body-vent inner opening 174, which body-vent inner opening 174 is an opening in the body interior 114 that is narrower than the outer part of the body-vent void 170. The outer portion of the vent structure 160 has, it has been found advantageous, a vent plug slot 166 which is larger than the vent hole 164. The rear, or outer, surface of the vent structure 160 is sized to be seated securely in a body-vent outer opening 172, which is an opening in the body exterior 112 of the main body 110, when the vent structure 160 is seated securely in the body-vent void 170.

Figure 16A:
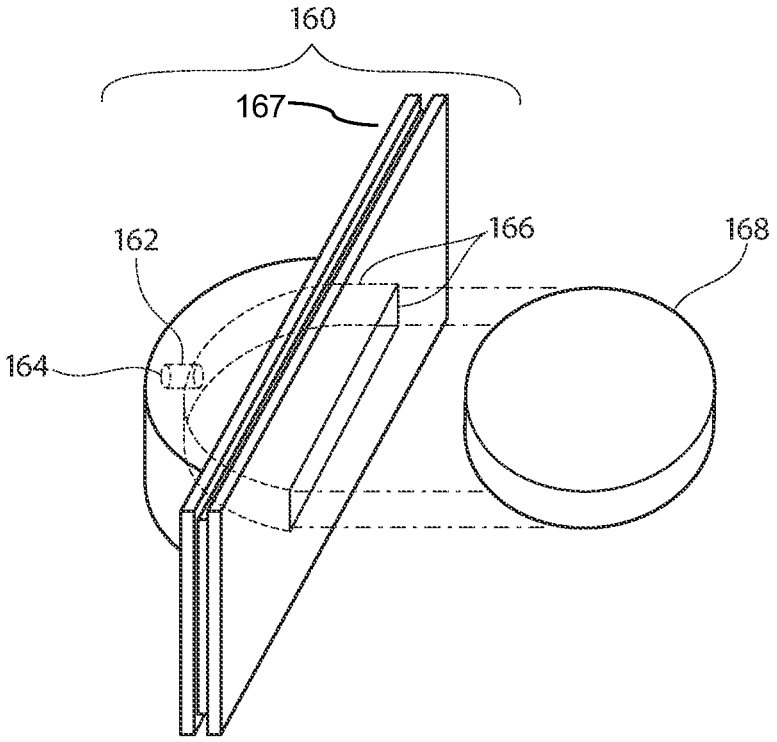
FIG. 16A shows a perspective view of an aspect of the vent structure component of the apparatus of the present invention, without the rest of the apparatus shown.
Figure 16B:
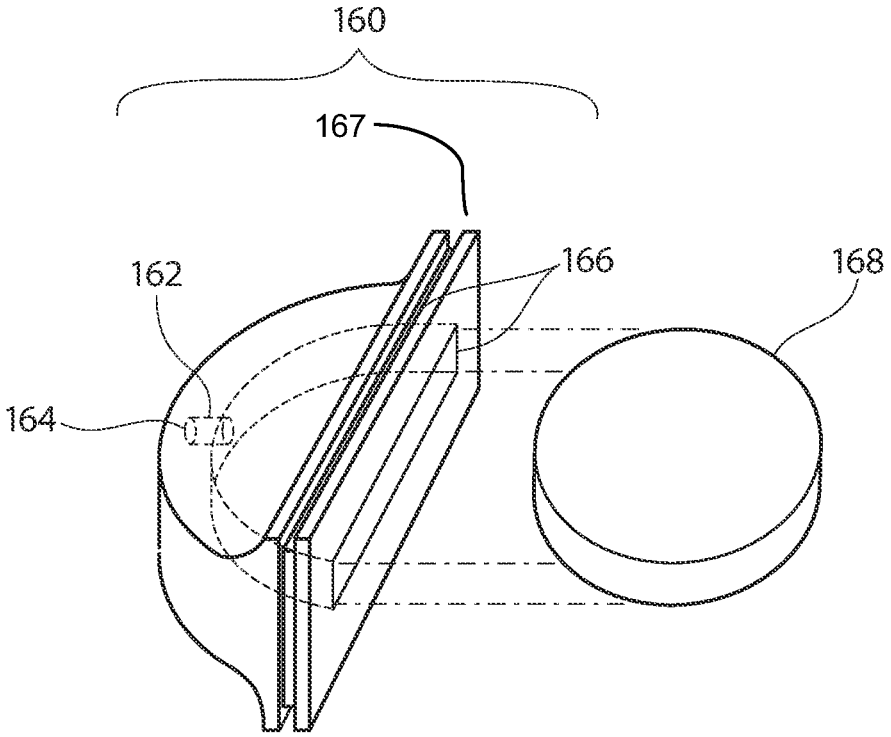
FIG. 16B shows a perspective view of an aspect of the vent structure component of the apparatus of the present invention, without the rest of the apparatus shown.
Figure 17A:
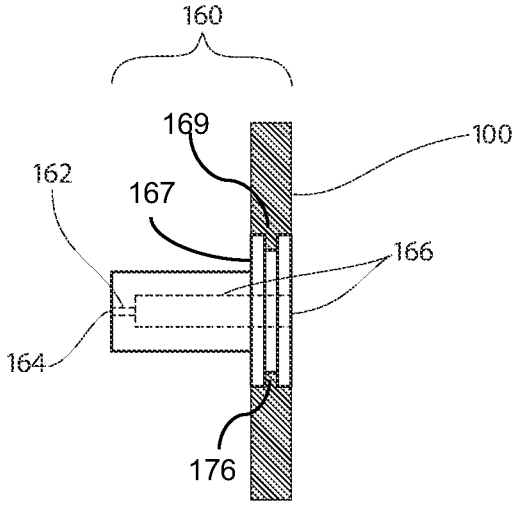
FIG. 17A, FIG. 17B, FIG. 17C, FIG. 17D, and FIG. 17E each show a cross-section view, from the side, of an aspect of the vent structure component of the apparatus of the present invention.
Figure 17B:
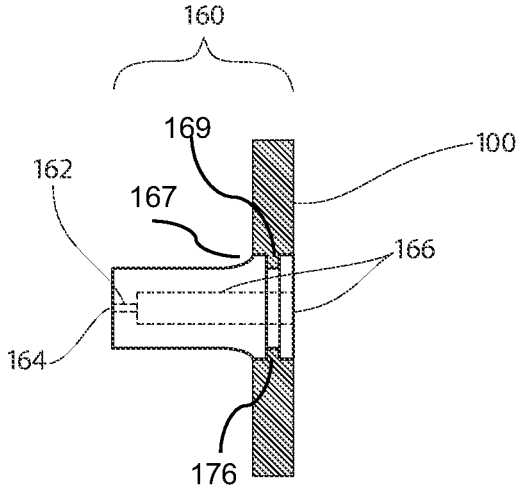
Figure 17C:
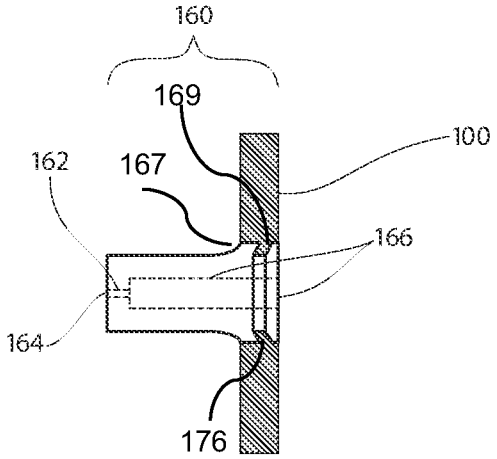
Figure 17D:
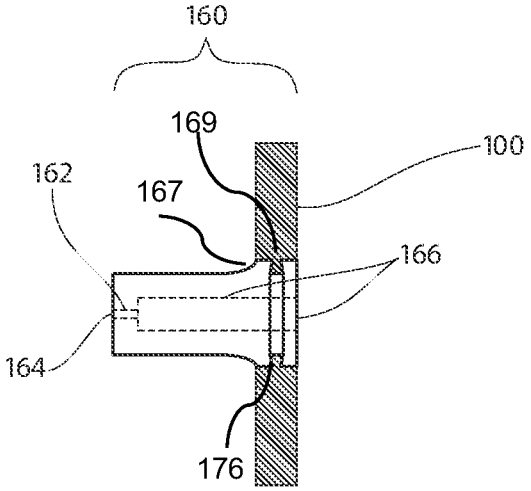
Figure 17E:
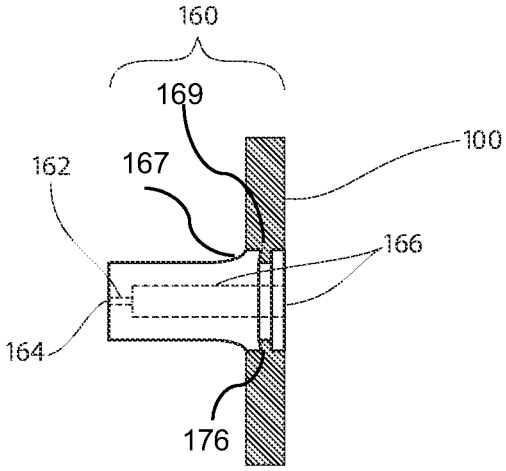

In some aspects of the present disclosure, and with reference to FIG. 16A, FIG. 16B, and FIG. 17A, FIG. 17B, FIG. 17C, FIG. 17D, and FIG. 17E, the vent structure 160, interior vent protrusion 162, vent hole 164, vent plug slot 166, and vent plug 168 are shown. As shown, and with further reference to FIG. 6, the vent structure 160 may have any of a variety of shapes, as will be apparent to one of skill in the art, and as may serve for different manufactures and assemblies of the main body 110 and the body-vent void 170. The vent structure 160 may comprise a distal wall 167 and a small proximal protrusion for the vent plug slot 166 as shown in FIG. 16A. Or, as shown in FIG. 16B, the vent structure 160 may comprise a large and rounded proximal protrusion for the vent plug slot 166. In both FIG. 16A and FIG. 16B, and with reference to FIG. 17A, FIG. 17B, FIG. 17C, FIG. 17D, and FIG. 17E, the vent structure 160 comprises the distal wall 167 configured to engage with the body-vent void 170. The distal wall 167 may have a variety of shapes, slants, angles, or tilts on its proximal side, such that the vent structure 160 can be reliably pushed into or inserted into the body-vent void 170, for assembly or replacement. The distal wall 167 may comprise a wall-slot 169, which is disposed in the distal wall 167 to engage with a body-vent-coupler 176, wherein the main body 110 further comprises the body-vent-coupler 176. The wall-slot 169 and the body-vent-coupler 176 may, advantageously, have a variety of complementary and matching shapes, such that the wall-slot 169 and the body-vent-coupler 176 may be easily and reversibly affixed together, thus securely latching the vent structure 160 into place in the body-vent void 170. As shown in FIG. 17A, FIG. 17B, FIG. 17C, FIG. 17D, and FIG. 17E, the cross-sectional shapes of the wall-slot 169 and of the body-vent-coupler 176 may be rectangular, slanted, dovetailed, or another configuration that will allow for simple assembly and/or replacement of the vent structure 160 into the body-vent void 170, and allow for the vent structure 160 to securely remain in the body-vent void 170.

The main body 110, it has been found advantageous, may comprise a relatively rigid material, which may be a plastic or a metal or other material now known or later invented, such that the apparatus 100 can bear the force required to be tapped in to a paint can 200, and securely seat a paint-can lid 210, and bear the weight of other paint cans 200 full of paint 230 when they are stacked. While, in some aspects of the present invention, it is possible to make the apparatus 100 without the vent structure 160 and have the body-vent void 170 serve as the vent through which air can flow to equalize pressure as described herein, it has been found less advantageous to have the body-vent void 170 plugged securely when it comprises the same relatively rigid material of the main body 110. It has been found advantageous to have the vent structure 160 comprise flexible or elastic material such that the vent structure 160 in combination with the vent plug 168, described herein, may serve to plug the body-vent void 170 in the relatively rigid main body 110.

The apparatus 100 may further comprise a vent plug 168, which is sized and shaped to be securely seated in the vent plug slot 166 from the outside of the vent structure 160 when the apparatus 100 is seated on a paint can 200. It has been found advantageous to have the vent plug 168 be a cylinder approximately 18-20 mm in diameter and approximately 1-2 mm in height, though other sizes of the vent plug 168 are possible, including but not limited to a half cylinder, an approximately ⅔ cylinder, or other portion of a cylinder, as will be understood by one of skill in the art. Other embodiments of the vent plug 168 are possible, and the vent plug 168 may be configured to have common household items used as the vent plug 168, including but not limited to a penny or other coin, a washer, or a nail. The vent plug 168 is used as a stopper, when paint 230 is not being poured from the paint can 200, to prevent air from flowing in or out of the vent hole 164 through the vent structure 160, so that the paint 230 in the paint can 200 does not dry out or become contaminated. When a user 240 wishes to pour paint 230 from the paint can 200, the user 240 may remove the vent plug 168 and the spout cap 142, and pour the paint 230 out of the paint can 200 without paint 230 splashing or sloshing out through the spout opening 146, as the air pressure inside the paint can 200 will equalize with the ambient outside air pressure through the vent hole 164. When the user 240 is done pouring paint 230 from the paint can 200, the user 240 can and should replace the spout cap 142 and the vent plug 168 to seal up the paint can 200, preventing the paint 230 from drying up, and preventing contaminants from getting into the paint 230. It has been found advantageous to have the spout cap 142 and the vent plug 168 be sized to be replaceable with common household items, including but not limited to a typical cap from a water, juice, or any other bottle, and a penny, washer, or nail, respectively, providing an advantage over prior art in that the components of the apparatus 100 are user-replaceable, rather than needing to discard an entire apparatus or locate and buy replacement parts, which provides a further advantage of the present invention, in that it prevents excess cost and excess waste relative to the prior art.

Figure 1:
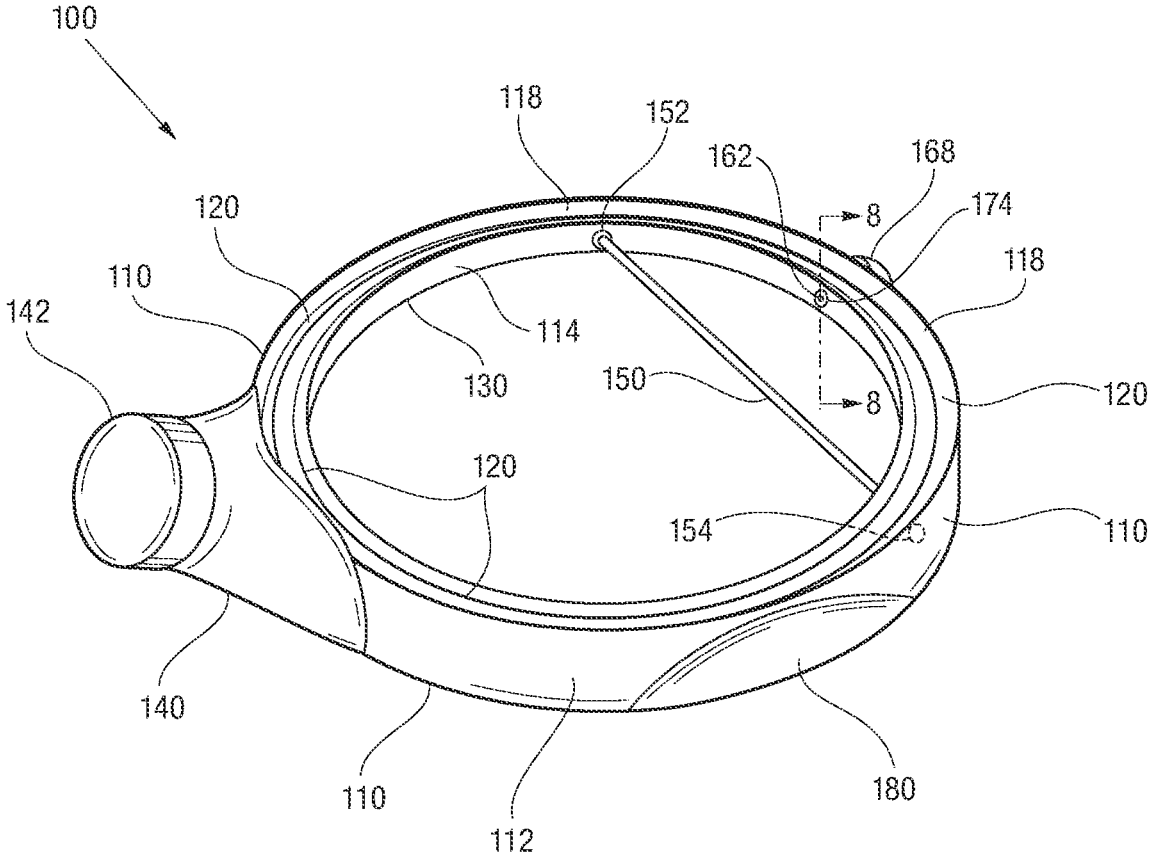
FIG. 1 shows a front and top perspective view of an aspect of the apparatus of the present invention.
Figure 2:
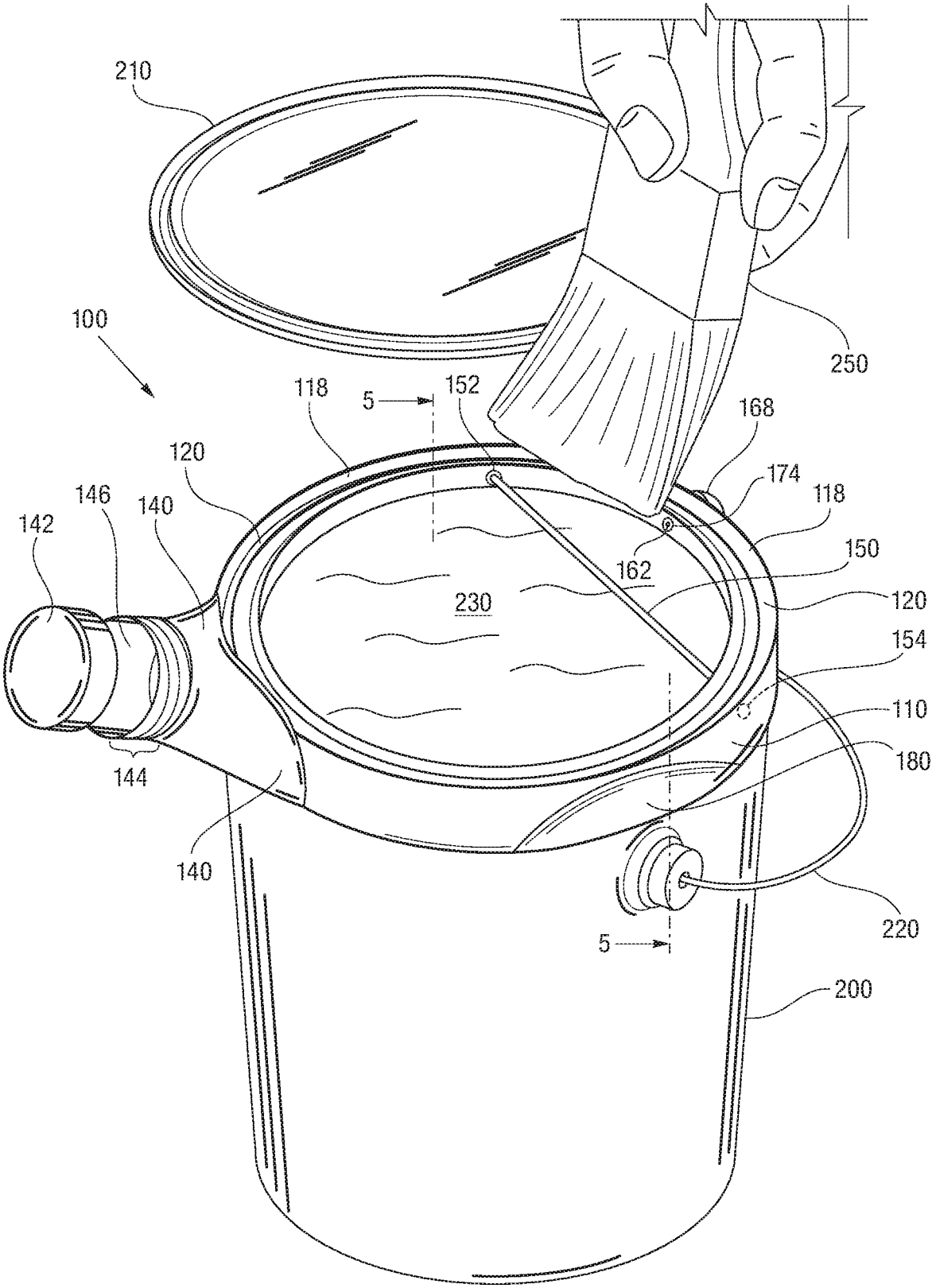
FIG. 2 shows a top and side perspective view of an aspect of the apparatus of the present invention, in use on a paint can.
Figure 3A:
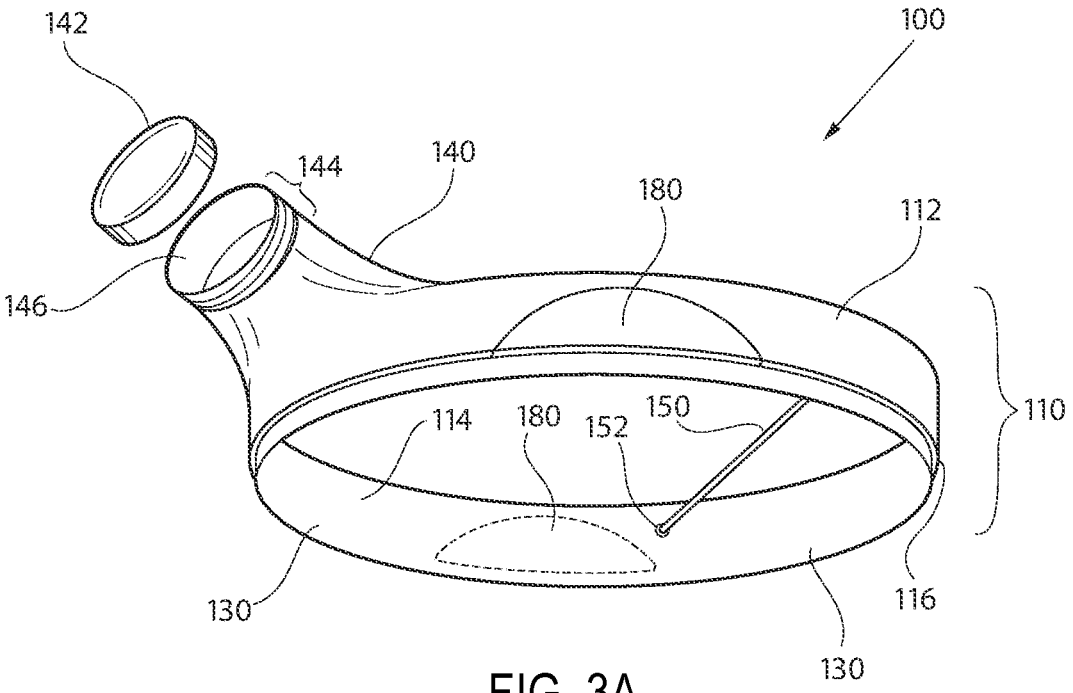
FIG. 3A shows a bottom and side perspective view of an aspect of the apparatus of the present invention.
Figure 3B:
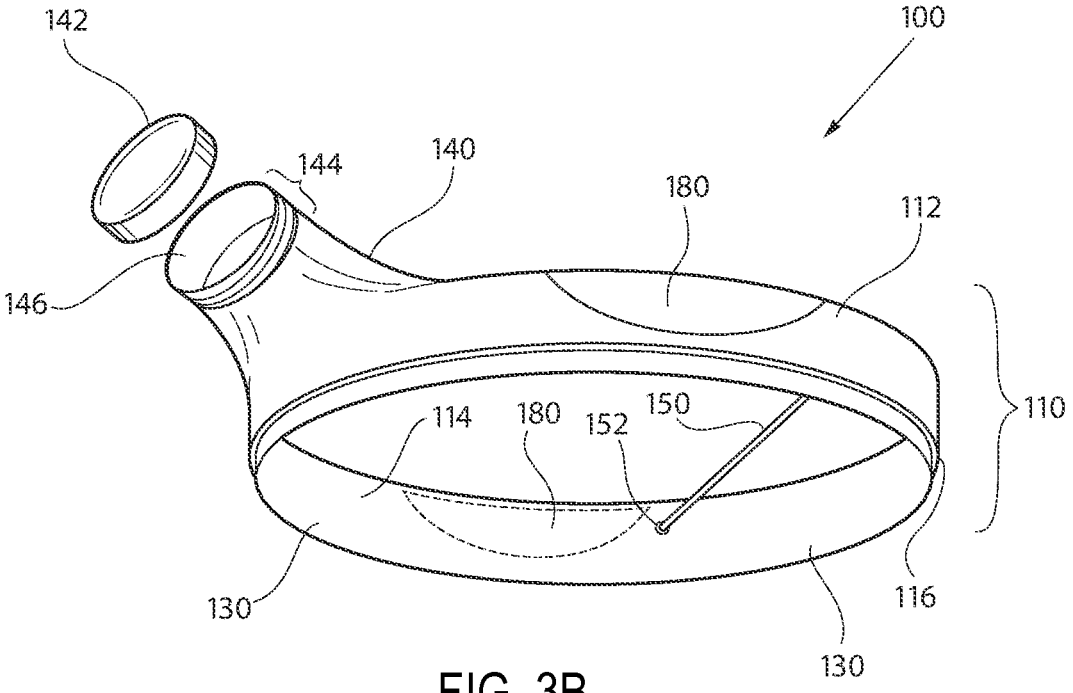
FIG. 3B shows a bottom and side perspective view of an aspect of the apparatus of the present invention.
Figure 4:
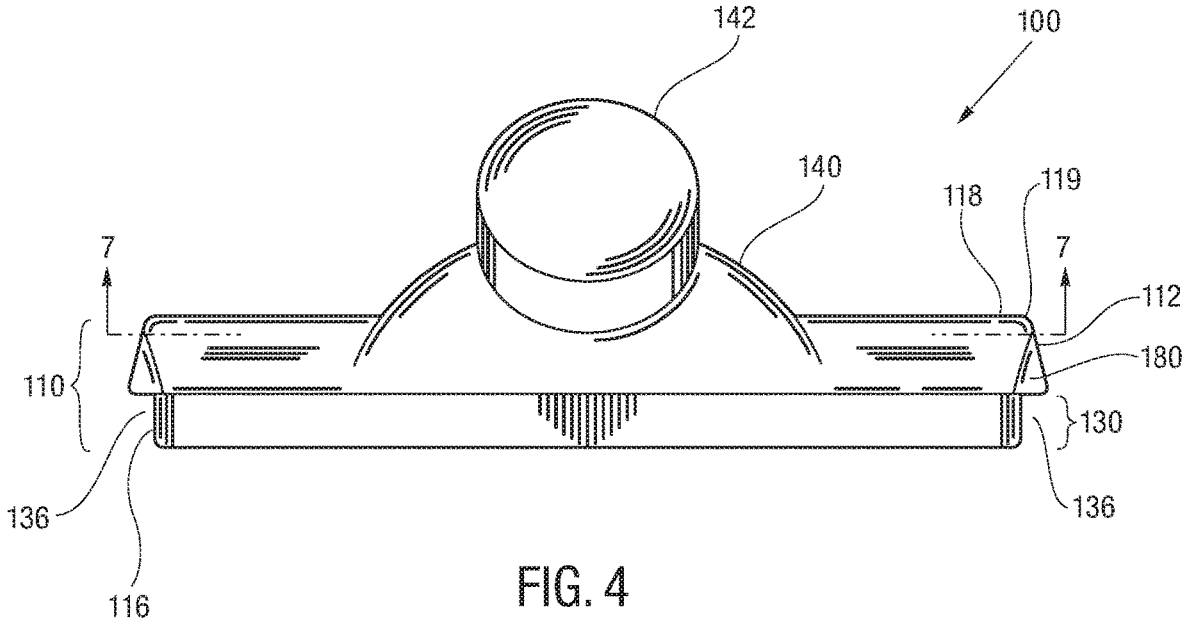
FIG. 4 shows a front elevation view of an aspect of the apparatus of the present invention.
Figure 5:
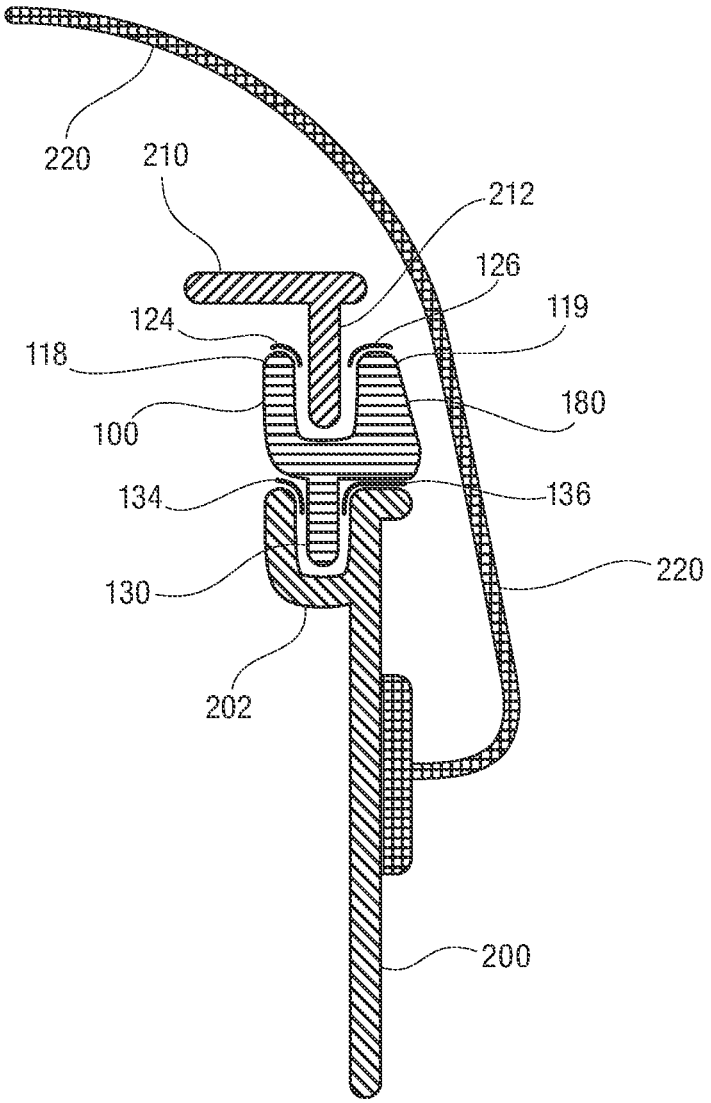
FIG. 5 shows a partial cross-section view, from the front, of an aspect of the apparatus of the present invention, in use on a paint can.
Figure 6:
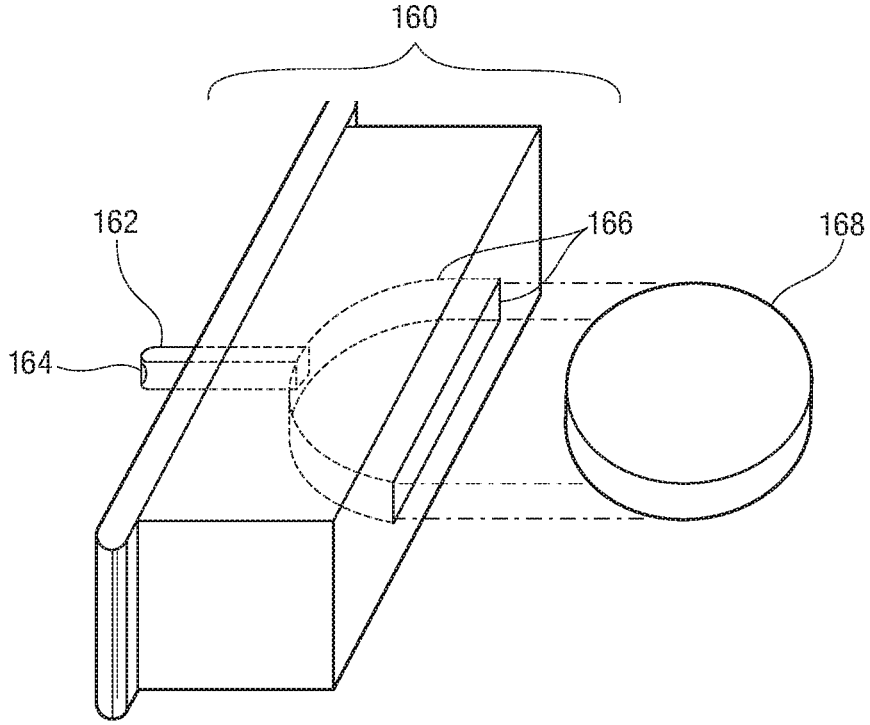
FIG. 6 shows a perspective view of an aspect of the vent structure component of the apparatus of the present invention, without the rest of the apparatus shown.
Figure 7:
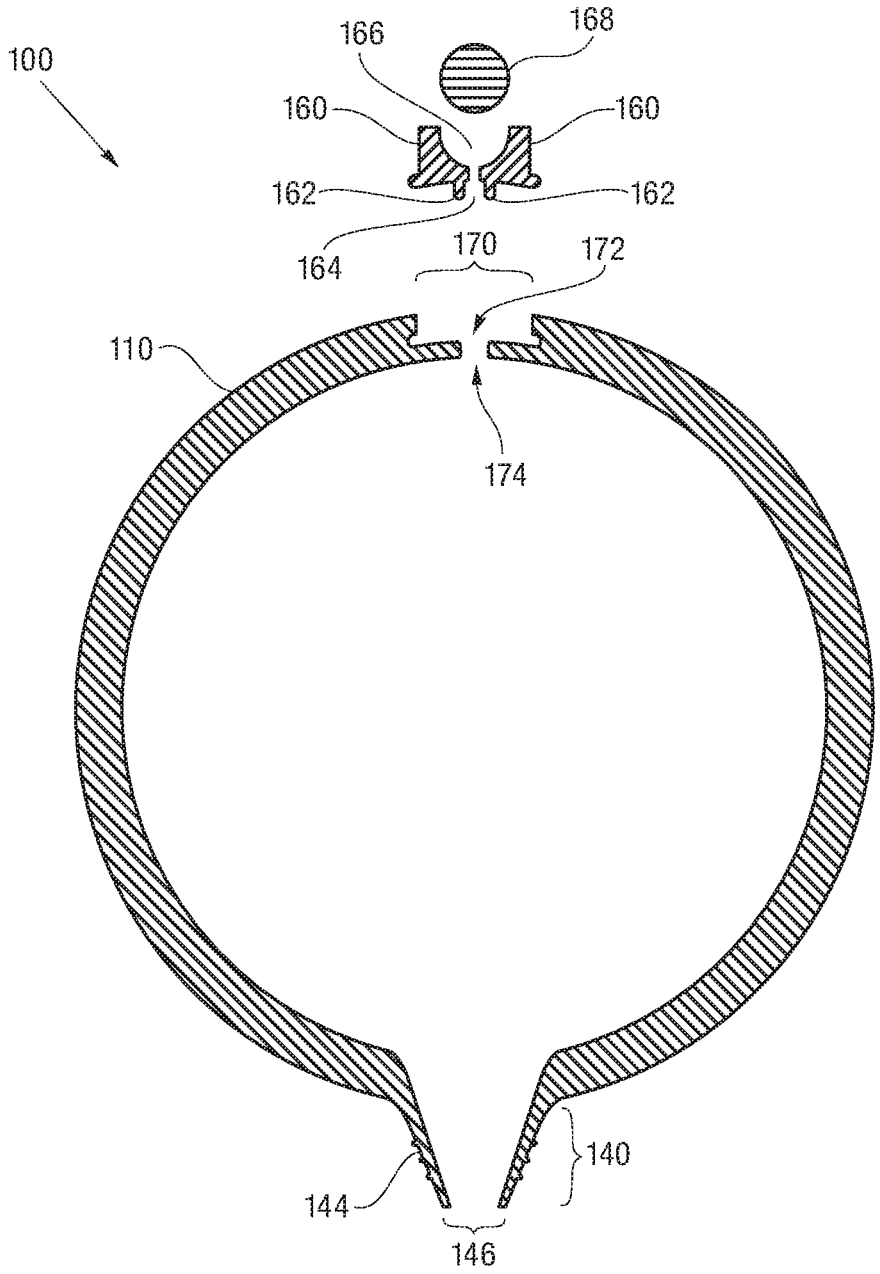
FIG. 7 shows an exploded cross-section view, from the top, of an aspect of the apparatus of the present invention.

With reference to FIG. 1, FIG. 2, FIG. 3A, FIG. 3B, and FIG. 5, the apparatus 100 may further comprise a plurality of lateral concavities 180. Note that, while FIG. 2 indicates the partial cross-section view of FIG. 5, FIG. 2 shows a paint-can-handle 220 resting in a lowered position against the side of the paint can 200 for clarity of the view of the apparatus 100 in FIG. 2, whereas in FIG. 5 the paint-can-handle 220 is shown in a raised position, directly vertical from where the paint-can-handle 220 attaches to the paint can 200, to show in the cross-section of FIG. 5 the position of the paint-can-handle 220 when the paint-can-handle 220 is being used to carry the paint can 200, in order to illustrate how the plurality of lateral concavities 180 enable the apparatus 100 to be used and allow the paint-can-handle 220 to be used to carry the paint can 200. The plurality of lateral concavities 180 may be fairings or slight indentations in the sides of the main body 110 of the apparatus 100, which plurality of lateral concavities 180 function to allow the paint-can-handle 220 of the paint can 200 to be used, by permitting the paint-can-handle 220 to swing upwards from a not-in-use position, as shown in FIG. 2, to a fully vertical in-use position, as shown in FIG. 5. Without the plurality of lateral concavities 180, the paint-can-handle 220 would be impeded by the outer edges of the main body 110, at the body exterior 112 and the distal body upper surface 119, and it would be difficult or impossible to have the paint-can-handle 220 swing freely so that the paint can 200 can be easily carried, or used to help hold the paint can 200 when pouring paint 230 from the paint can 200, with the apparatus 100 in place on the paint can 200. With the plurality of lateral concavities 180, the paint-can-handle 220 can be more readily and conveniently used while the apparatus 100 is in place on the paint can 200, improving on the prior art. As will be apparent to one of skill in the art, the lateral concavities 180 may in some aspects of the present invention be shaped to have a diameter of the apparatus 100 be larger towards the bottom of the apparatus 100, in the region of the lateral concavities 180, as shown in FIG. 4 and FIG. 5, to accommodate the motion of the paint-can-handle 220, with an arc-like or other shape of material removed or not present above the lower part of the apparatus. In other aspects of the present invention, the lateral concavities 180 may be shaped to have a diameter of the apparatus 100 be smaller towards the bottom of the apparatus 100, in the region of the lateral concavities 180, as shown in FIG. 1, FIG. 2, and FIG. 3A, to accommodate the motion of the paint-can-handle 220, with an arc-like or other shape of material removed or not present above the lower part of the apparatus 100, with more material removed from the bottom of the apparatus 100 than from the upper portion of the apparatus 100. In other aspects of the present invention, the lateral concavities 180 may be shaped to have a diameter of the apparatus 100 be smaller towards the top of the apparatus 100, in the region of the lateral concavities 180, as shown in FIG. 3B, to accommodate the motion of the paint-can-handle 220, with an arc-like or other shape of material removed or not present above the lower part of the apparatus 100, with more material removed from the top of the apparatus 100 than from the lower portion of the apparatus 100. In other aspects of the present invention, the lateral concavities 180 may be shaped in the apparatus 100 by having the cross-sectional shape of the apparatus 100 be a triangle or approximately a rounded triangle, or other shape that, as will be apparent to one of skill in the art, would accommodate the motion of the paint-can-handle 220. Such a cross-sectional shape of the apparatus 100 may, in some aspects of the invention, be used in most or all of the apparatus 100, or may in some aspects of the present invention be used only in the vicinity of the lateral concavities 180.

Certain aspects of the present invention were described above. From the foregoing it will be seen that this invention is one well adapted to attain all the ends and objects set forth above, together with other advantages, which are obvious in and inherent to the inventive apparatus disclosed herein. It will be understood that certain features and sub-combinations are of utility and may be employed without reference to other features and sub-combinations. It is expressly noted that the present invention is not limited to those aspects described above, but rather the intention is that additions and modifications to what was expressly described herein are also included within the scope of the invention. Moreover, it is to be understood that the features of the various aspects described herein are not mutually exclusive and can exist in various combinations and permutations, even if such combinations or permutations were not made express herein, without departing from the spirit and scope of the invention. In fact, variations, modifications, and other implementations of what was described herein will occur to those of ordinary skill in the art without departing from the spirit and the scope of the invention. As such, the invention is not to be defined only by the preceding illustrative description.

Accordingly, what is claimed is:

1. A paint can accessory apparatus to allow improved pouring, storing, and painting using a paint can, the apparatus comprising:

a main body, which main body further comprises a body exterior, a body interior having a surface, a body-vent void, and an inner collar, the inner collar further comprising a plurality of collar rings; and a vent structure, disposed to be securely seated in the body-vent void, wherein the vent structure comprises a vent hole and a vent plug slot.

2. The paint can accessory apparatus of claim 1, the inner collar further comprising a frictive region.

3. The paint can accessory apparatus of claim 1, the inner collar further comprising a coating.

4. The paint can accessory apparatus of claim 1, the apparatus further comprising a proximal body upper surface, and an apparatus lid which further comprises a plurality of apparatus-lid-prongs, and wherein the plurality of apparatus-lid-prongs are disposed to be securely seated distal to the proximal body upper surface.

5. The paint can accessory apparatus of claim 1, the apparatus further comprising a pour guard.

6. The paint can accessory apparatus of claim 1, the apparatus further comprising a wiper rod, wherein the wiper rod is replaceable; and a first wiper rod support, and a second wiper rod support, wherein the first wiper rod support comprises a circular ring raised from the surface of the body interior, and wherein the second wiper rod support comprises an open-jawed ring raised from the surface of the body interior.

7. The paint can accessory apparatus of claim 1, the vent structure further comprising a distal wall configured to engage with the body-vent void, wherein the distal wall further comprises a wall-slot, and the main body further comprising a body-vent-coupler, and wherein the wall-slot is disposed in the distal wall to engage with the body-vent-coupler.

8. A paint can accessory apparatus to allow improved pouring, storing, and painting using a paint can, the apparatus comprising:

a main body, which main body further comprises a body exterior, a body interior having a surface, a body-vent void, and a body lower surface further comprising a bottom base circular protrusion, and a proximal body upper surface, and a distal body upper surface;

a spout body, a spout closure, and a spout opening; and a vent structure, disposed to be securely seated in the body-vent void; wherein the vent structure comprises a vent hole and a vent plug slot.

9. The paint can accessory apparatus of claim 8, the vent structure further comprising a distal wall configured to engage with the body-vent void.

10. The paint can accessory apparatus of claim 9, the distal wall further comprising a wall-slot, and the main body further comprising a body-vent-coupler, and wherein the wall-slot is disposed in the distal wall to engage with the body-vent-coupler.

11. The paint can accessory apparatus of claim 8, the paint can accessory apparatus further comprising an inner collar, and wherein the inner collar comprises a plurality of collar rings.

12. The paint can accessory apparatus of claim 8, the apparatus further comprising a paint-can-lid receiving indentation and an apparatus lid, and wherein the apparatus lid fits securely and reversibly into the paint-can-lid receiving indentation.

13. The paint can accessory apparatus of claim 8, the apparatus further comprising an apparatus lid which further comprises a plurality of apparatus-lid-prongs, and wherein the plurality of apparatus-lid-prongs are disposed to be securely seated distal to the proximal body upper surface.

14. The paint can accessory apparatus of claim 8, the apparatus further comprising a pour guard.

15. The paint can accessory apparatus of claim 8, the apparatus further comprising a wiper rod, wherein the wiper rod is replaceable; and a first wiper rod support, and a second wiper rod support, wherein the first wiper rod support comprises a circular ring raised from the surface of the body interior, and wherein the second wiper rod support comprises an open-jawed ring raised from the surface of the body interior.

* * * * *